US011454918B2

(12) United States Patent
Shinoya

(10) Patent No.: US 11,454,918 B2
(45) **Date of Patent: *Sep. 27, 2022**

(54) IMAGE FORMING APPARATUS

(71) Applicant: BROTHER KOGYO KABUSHIKI KAISHA, Nagoya (JP)

(72) Inventor: Shota Shinoya, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/178,326

(22) Filed: Feb. 18, 2021

(65) Prior Publication Data

US 2021/0173338 A1 Jun. 10, 2021

Related U.S. Application Data

(63) Continuation of application No. 16/786,455, filed on Feb. 10, 2020, now Pat. No. 10,935,921.

(30) Foreign Application Priority Data

Feb. 22, 2019 (JP) ..... JP2019-030994

(51) Int. Cl.
*G03G 15/00* (2006.01)
*G03G 21/16* (2006.01)

(52) U.S. Cl.
CPC ..... *G03G 21/1633* (2013.01); *G03G 21/168* (2013.01); *G03G 2221/169* (2013.01); *G03G 2221/1684* (2013.01)

(58) Field of Classification Search
CPC ..... G03G 15/0863; G03G 21/1633; G03G 21/1652; G03G 21/1867; G03G 21/1875; G03G 2221/166; G03G 2221/1823
USPC ..... 399/75, 90, 107, 110–114
See application file for complete search history.

(56) References Cited

U.S. PATENT DOCUMENTS

| | | | | |
|---|---|---|---|---|
| 5,822,654 | A | 10/1998 | Damji et al. | |
| 8,301,456 | B2 | 10/2012 | Gazdzinski et al. | |
| 8,781,355 | B2 | 7/2014 | Koishi | |
| 8,938,179 | B2 | 1/2015 | Amann et al. | |
| 9,946,190 | B2 * | 4/2018 | Itabashi | G03G 21/1652 |
| 10,031,472 | B2 | 7/2018 | Itabashi et al. | |

(Continued)

FOREIGN PATENT DOCUMENTS

| | | | |
|---|---|---|---|
| CN | 104090471 | A | 10/2014 |
| JP | 2010-128336 | A | 6/2010 |
| JP | 2019-28345 | A | 2/2019 |

*Primary Examiner* — Hoan H Tran
(74) *Attorney, Agent, or Firm* — Merchant & Gould P.C.

(57) ABSTRACT

An image forming apparatus includes a drawer, a drawer-side electrical contact, a cover, a main body-side electrical contact and an elastic member interposed between a base and a panel. The main body-side electrical contact and the panel are held to be movable relative to the base in a third direction as being an extension and contraction direction of the elastic member. The image forming apparatus takes: a first state where the cover is open, the drawer-side electrical contact contacts the main body-side electrical contact, and the elastic member has a first length; and a second state where the cover is closed, the drawer-side electrical contact contacts the main body-side electrical contact, and the elastic member in the third direction has a second length shorter than the first length.

7 Claims, 29 Drawing Sheets

(56) References Cited

U.S. PATENT DOCUMENTS

| | | | | |
|---|---|---|---|---|
| 10,101,706 | B2 | 10/2018 | Yokoi | |
| 10,254,709 | B2 * | 4/2019 | Mizutani | G03G 21/1652 |
| 10,935,921 | B2 * | 3/2021 | Shinoya | G03G 21/1867 |
| 2010/0135693 | A1 | 6/2010 | Okabe et al. | |
| 2019/0041792 | A1 | 2/2019 | Kishi et al. | |

* cited by examiner

※ L1 < L2

IMAGE FORMING APPARATUS

CROSS-REFERENCE TO RELATED APPLICATIONS

This application is a continuation of U.S. patent application Ser. No. 16/786,455, filed Feb. 10, 2020, now U.S. Pat. No. 10,935,921, and is based on and claims priority under 35 USC 119 from Japanese patent application No. 2019-030994 filed on Feb. 22, 2019. The contents of the aforementioned applications are incorporated herein by reference.

TECHNICAL FIELD

The present disclosure relates to an image forming apparatus.

BACKGROUND

There has been proposed an electrophotographic image forming apparatus such as a laser printer and an LED printer. The related-art image forming apparatus includes a drawer. The drawer includes a plurality of photosensitive drums. A plurality of developing cartridges is removably insertable to the drawer. When the developing cartridges are inserted to the drawer, developing rollers of the developing cartridges and the photosensitive drums of the drawer are contacted to each other. The drawer having the developing cartridges inserted thereto is accommodated in a housing of an image forming apparatus main body.

SUMMARY

Illustrative aspects of the present disclosure provide an image forming apparatus capable of enabling smooth connection between an electrical contact part on a drawer-side and an electrical contact part on an image forming apparatus main body-side and suppressing load to be applied to a drawer-side connector and a main body-side connector.

According to one illustrative aspect of the present disclosure, an image forming apparatus configured as described below is provided. That is, an image forming apparatus may comprise a drawer and an image forming apparatus main body. The drawer may comprise: a frame configured to hold a plurality of photosensitive drums while spacing the plurality of photosensitive drums at intervals in a second direction, each of the plurality of photosensitive drums being rotatable about an axis extending in a first direction; a drawer memory storing at least one of information about at least one of the plurality of photosensitive drums and information about developing cartridges removably insertable to the frame; and a drawer-side connector located at an outer surface of the frame on one side in the second direction and on a downstream side of the drawer with respect to an insertion direction, the drawer-side connector comprising: a drawer-side electrical contact part electrically connected to the drawer memory; and a drawer-side holder configured to hold therein the drawer-side electrical contact part. The image forming apparatus main body may comprise: a housing having an internal space, the drawer being accommodated in the internal space by moving the drawer relative to the housing in the second direction as being the insertion direction; a controller; a cover rotatable between an open position opening the internal space and a closed position closing the internal space; and a main body-side connector comprising: a main body-side electrical contact part located at an inner surface of the housing on one side in the second direction, the main body-side electrical contact part electrically connected to the controller; and a main body-side holder configured to hold therein the main body-side electrical contact part. The main body-side holder may comprise: a base; a panel, the main body-side electrical contact part being fixed to the panel; and an elastic member interposed between the base and the panel, the main body-side connector holding the panel to be movable relative to the base in a direction corresponding to deformation of the elastic member. The main body-side connector may be configured to hold the main body-side electrical contact part and the panel to be movable relative to the base in a third direction as being an extension and contraction direction of the elastic member. The image forming apparatus may be configured to take a first state and a second state. In the first state, the drawer is accommodated in the internal space, and the cover is in the open position, the drawer-side electrical contact part is in contact with the main body-side electrical contact part, and a length of the elastic member in the third direction is a first length. In the second state, the drawer is accommodated in the internal space, and the cover is in the closed position, the drawer-side electrical contact part is in contact with the main body-side electrical contact part, and the length of the elastic member in the third direction is a second length, the second length being shorter than the first length.

According thereto, the image forming apparatus capable of enabling smooth connection between the electrical contact part on the drawer-side and the electrical contact part on the image forming apparatus main body-side and suppressing load to be applied to the drawer-side connector and the main body-side connector may be provided.

BRIEF DESCRIPTION OF DRAWINGS

Illustrative embodiments of the disclosure will be described in detail based on the following figures, wherein.

DETAILED DESCRIPTION

There has been proposed a developing cartridge including a storage medium. In the storage medium, a variety of information about the developing cartridge is stored. Also, in the drawer, a variety of information about the photosensitive drum is handled. For this reason, the drawer is also required to mount a storage medium in which the variety of information about the photosensitive drum is stored. Not only in a case in which the storage medium having the information about the photosensitive drum stored therein is mounted to the drawer and but also in a case in which a storage medium having information about a developing cartridge stored therein is mounted to the drawer via the developing cartridge, the storage media are required to be electrically connected to an image forming apparatus main body-side controller.

However, in the case in which the drawer is accommodated in the housing of the image forming apparatus main body, an error may occur in a positional relation between an electrical contact part on the drawer-side and an electrical contact part on the image forming apparatus main body-side. In this case, the electrical contact part on the drawer-side and the electrical contact part on the image forming apparatus main body-side may not be smoothly connected. In this case, if it is intended to forcibly connect the electrical contact part on the drawer-side and the electrical contact part on the image forming apparatus main body-side each other, high load may be applied to a drawer-side connector and a main body-side connector.

Therefore, illustrative aspects of the present disclosure provide an image forming apparatus enabling smooth connection between an electrical contact part on a drawer-side and an electrical contact part on an image forming apparatus main body-side and suppressing load to be applied to a drawer-side connector and a main body-side connector.

Hereinbelow, an illustrative embodiment of the present disclosure will be described with reference to the accompanying drawings.

In descriptions below, a direction in which an axis of rotation center (drum axis) of a photosensitive drum extends is referred to as "first direction". Also, a direction in which a plurality of photosensitive drums is aligned is referred to as "second direction". The first direction and the second direction intersect with each other, and are preferably perpendicular to each other. Also, a direction in which a main body-side holder extends is referred to as "third direction". Also, a direction that intersects with and are preferably perpendicular to any of the first direction and the second direction is referred to as "fourth direction". Also, a direction perpendicular to the first direction and the third direction is referred to as "fifth direction".

<1. Configuration of Image Forming Apparatus>

Figure 1:
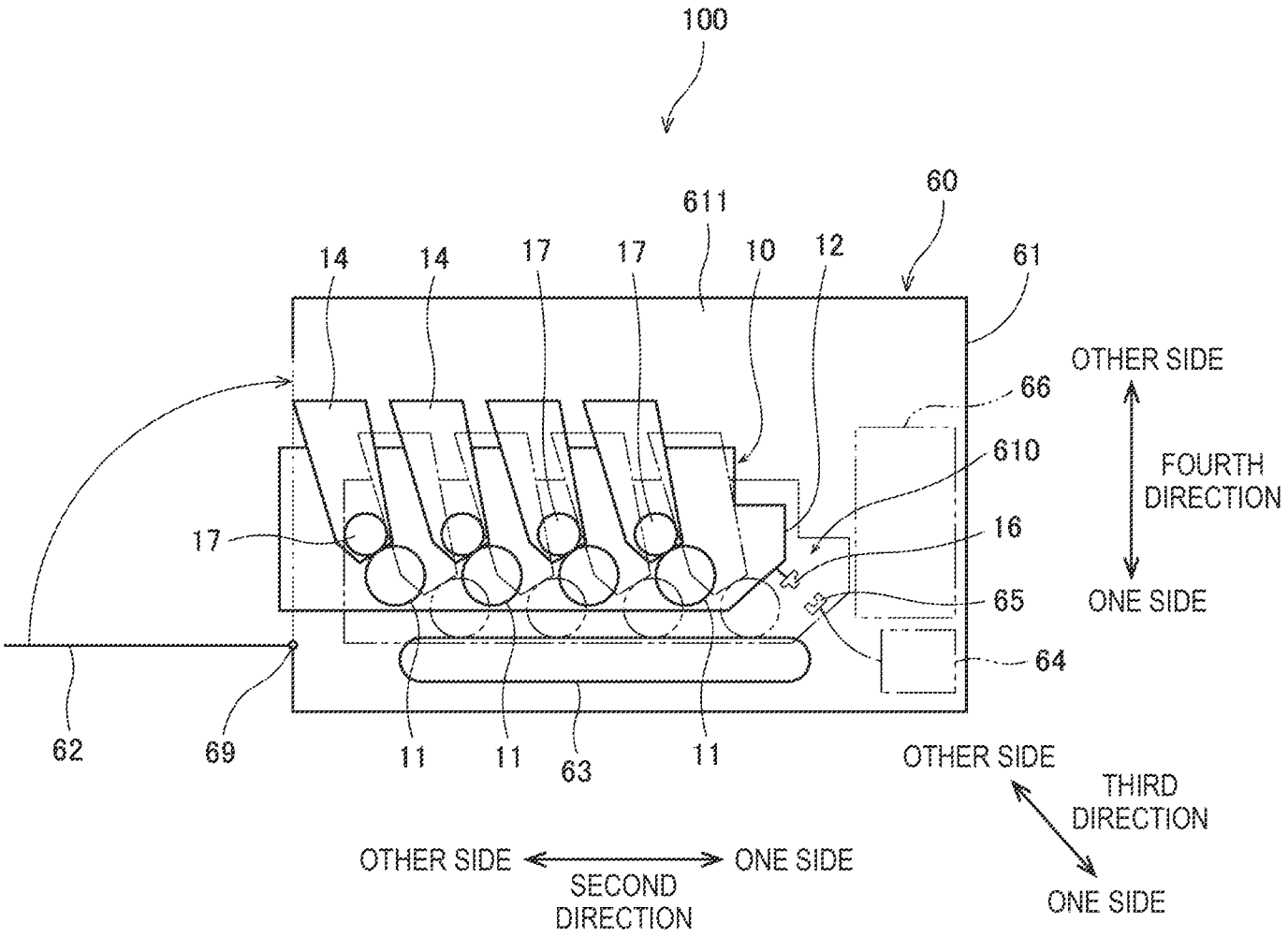
FIG. 1 is a schematic view of an image forming apparatus.
Figure 2:
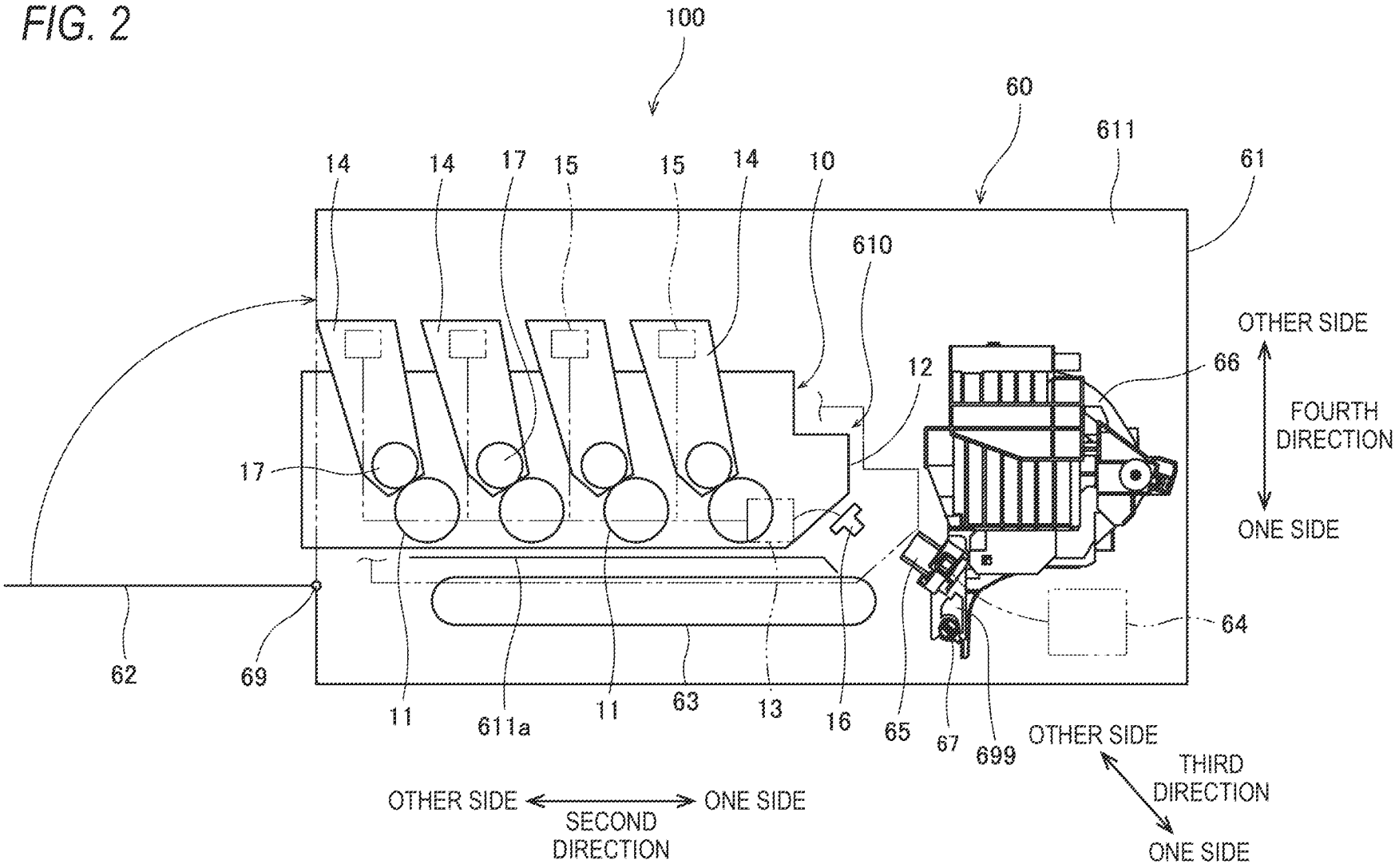
FIG. 2 is a schematic view of the image forming apparatus.

FIGS. 1 and 2 are schematic views of an image forming apparatus 100. The image forming apparatus 100 is an electrophotographic printer. As the image forming apparatus, a laser printer or an LED printer may be exemplified. As shown in FIGS. 1 and 2, the image forming apparatus 100 includes a drawer 10, and an image forming apparatus main body 60.

<1-1. Configuration of Drawer>

Figure 3:
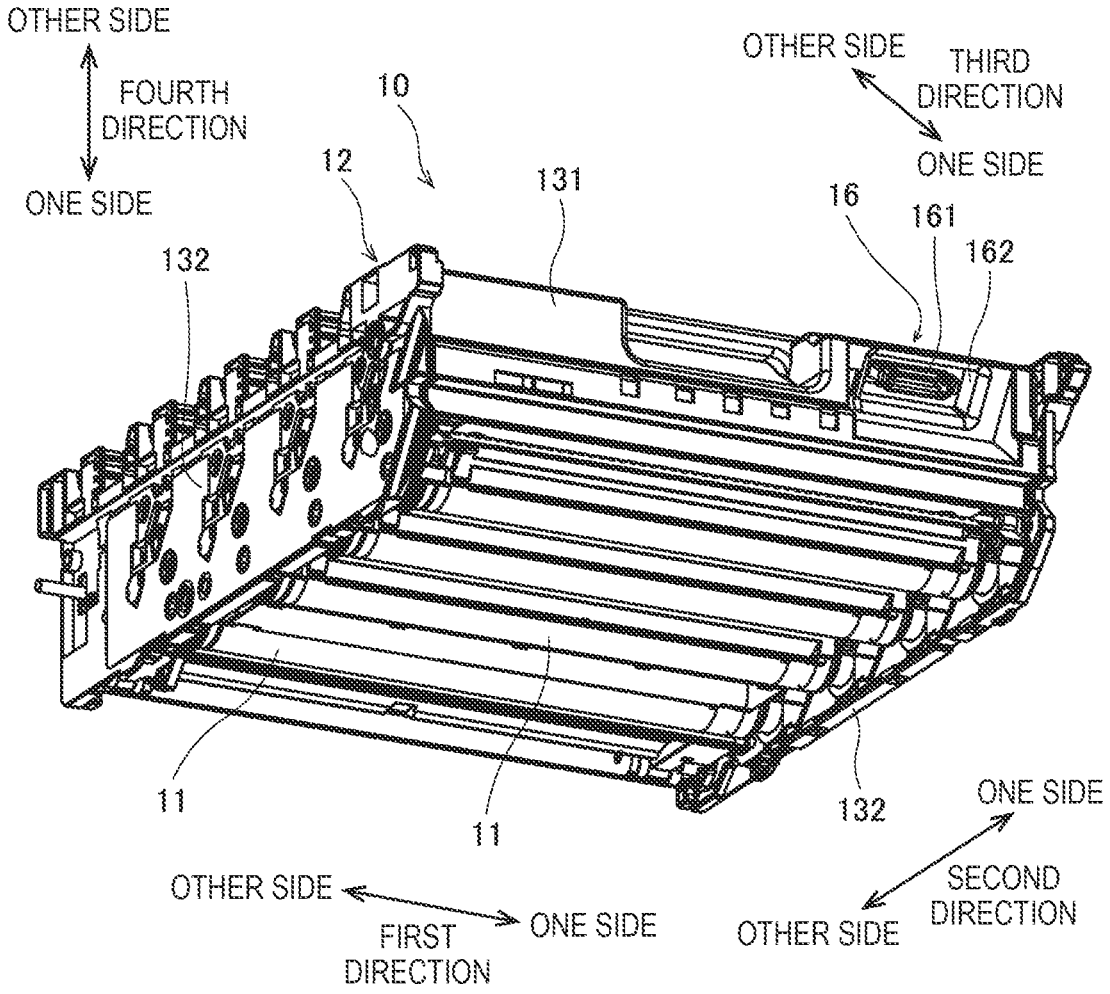
FIG. 3 is a perspective view of a drawer.
Figure 4:
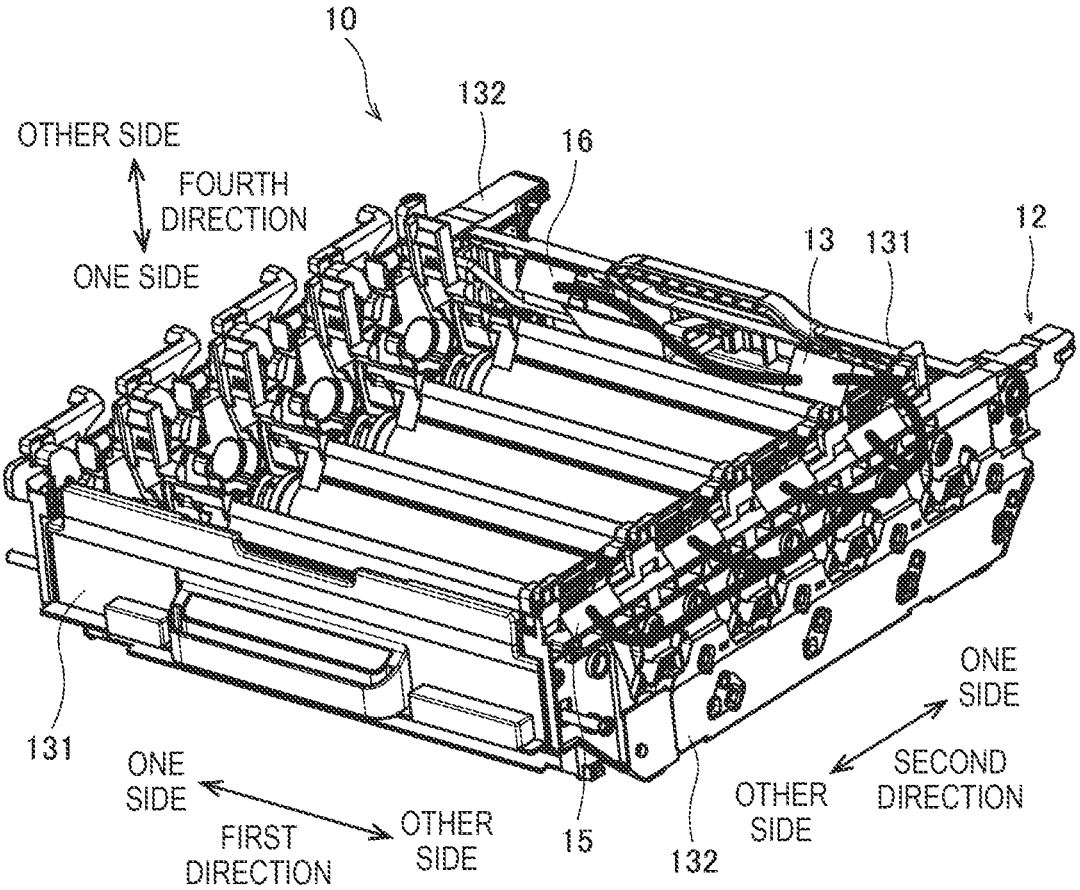
FIG. 4 is a perspective view of the drawer.

In the below, a configuration of the drawer 10 is described. FIGS. 3 and 4 are perspective views of the drawer 10. As shown in FIGS. 1 to 4, the drawer 10 includes four photosensitive drums 11, a frame 12, a drum memory (drawer memory) 13, four developing cartridges 14, four toner memories (drawer memory) 15, and a drawer-side connector 16.

As shown in FIGS. 3 and 4, each of the four photosensitive drums 11 has a cylindrical outer peripheral surface of which a center is a drum axis, which is an axis of rotation center extending in the first direction. The outer peripheral surface of the photosensitive drum 11 is covered with a photosensitive material. Also, each of the four photosensitive drums 11 is rotatable about the drum axis.

As shown in FIGS. 3 and 4, the frame 12 is a frame body configured to support the four photosensitive drums 11. The frame 12 is configured to hold the plurality of photosensitive drums 11 while spacing the same in the second direction. The frame 12 has a pair of the base plates 131 facing in the second direction, and a pair of side plates 132 facing in the first direction.

As shown in FIGS. 1 and 2, the developing cartridge 14 is removably insertable to the frame 12. The developing cartridge 14 has a housing in which toner, which is developing agent, can be accommodated. The four developing cartridges 14 accommodate therein toners of different colors (for example, cyan, magenta, yellow and black). Also, in the present illustrative embodiment, the developing cartridge 14 has a developing roller 17. The developing roller 17 is a cylindrical member. The developing roller 17 is rotatable about a developing axis, which is an axis of rotation center extending in the first direction. When the developing cartridge 14 is inserted to the frame 12, the outer peripheral surface of the photosensitive drum 11 is in contact with an outer peripheral surface of the developing roller 17.

The drum memory 13, the toner memory 15, and the drawer-side connector 16 will be described in detail later.

<1-2. Configuration of Image Forming Apparatus Main Body>

In the below, a configuration of the image forming apparatus main body 60 is described. As shown in FIGS. 1 and 2, the image forming apparatus main body 60 includes a housing 61, a cover 62, a transfer belt 63, a controller 64, a main body-side connector 65, a sheet discharger 66, and a reference shaft 67.

The housing 61 has a substantial cuboid shape, and includes an internal space 610. The housing 61 has a pair of side frames 611 (refer to FIGS. 19 and 21) facing in the first direction. In the internal space 610 of the housing 61, the drawer 10 can be accommodated by moving the same relative to the housing 61 in an insertion direction. In the present illustrative embodiment, the "insertion direction" is a direction facing toward one side in the second direction. Like this, the drawer 10 having the developing cartridges 14 inserted thereto is accommodated in the housing 61. In addition, in the housing 61, four chargers (not shown), four light sources (not shown), the transfer belt 63, the controller 64, the main body-side connector 65, the sheet discharger 66, and the reference shaft 67 are accommodated.

The cover 62 is movable between an open position shown with the solid line in FIG. 1 and a closed position shown with the dashed-two dotted line in FIG. 1. Specifically, the cover 62 is rotatable about a hinge 69 extending in the first direction. When the cover 62 is arranged in the open position, the internal space 610 of the housing 61 is opened. When the cover 62 is arranged in the closed position, the internal space 610 of the housing 61 is closed.

A user of the image forming apparatus 100 is movable the drawer 10 having the developing cartridges 14 inserted thereto in the insertion direction, in a state in which the cover 62 is located in the open position. Thereby, the drawer 10 is movable between a separation position in which at least a part thereof is located outside of the housing 61 and an installation position in which the drawer is set in the internal space 610.

The transfer belt 63 is an endless band-shaped belt for conveying a print sheet. The transfer belt 63 is positioned on an opposite side to the developing rollers 17 with the photosensitive drums 11 being interposed therebetween, in a state in which the drawer 10 is arranged in the installation position. An outer peripheral surface of the transfer belt 63 is contactable the outer peripheral surfaces of the photosensitive drums 11 in a state in which the drawer 10 is arranged in the installation position.

The sheet discharger 66 is a unit for guiding a print sheet having an image formed thereon to a sheet discharge tray (not shown) at an upper part of the housing 61. The sheet discharger 66 has a path for conveying the print sheet to the sheet discharge tray and a plurality of conveyor rollers arranged along the path. The sheet discharger 66 is provided downstream of the internal space 610 of the housing 61 with respect to the insertion direction. In other words, the sheet discharger 66 is provided along an inner surface of the housing 61 on one side in the second direction.

The controller 64 includes a processor such as a CPU, and a main body memory. The main body memory is a recording medium from and into which information can be read and written. The main body memory is, for example, a flash ROM or EEPROM. In the main body memory, a computer program for controlling operations of the image forming apparatus 100 is stored. The processor is configured to execute a variety of processing according to the computer program stored in the main body memory. That is, the processor is configured to execute printing processing of the image forming apparatus 100 and a variety of processing associated therewith.

The main body-side connector 65 and the reference shaft 67 will be described in detail later.

<1-3. Configuration Relating to Electrical Connection>

In the below, a configuration of electrical connection of the image forming apparatus 100 is described. Specifically, the drum memory 13, the toner memory 15, the drawer-side connector 16, and the main body-side connector 65 are described with reference to FIGS. 2 and 4.

<1-3-1. Configuration Relating to Electrical Connection of Drawer>

The drawer 10 has, as a configuration relating to electrical connection, the drum memory 13, the toner memory 15, and the drawer-side connector 16.

In the drum memory 13, information about at least one of the four photosensitive drums 11 is stored. Specifically, in the drum memory 13 of the present illustrative embodiment, drum identification information capable of identifying each photosensitive drum 11 and drum life-span information about life-span of the photosensitive drum 11 are stored. The drum identification information is, for example, a serial number. The drum life-span information is at least one of the number of rotations of the photosensitive drum 11 and the number of prints of the photosensitive drum 11. As shown in FIG. 4, the drum memory 13 of the present illustrative embodiment is positioned at an inner surface of the base plate 131, which is located at one side in the second direction, of the pair of the base plates 131. The drum memory 13 is configured to relay electrical connection between the toner memory 15 and the drawer-side connector 16, which will be described later.

The toner memory 15 is individually provided to each developing cartridge 14. In the toner memory 15, toner identification information capable of identifying each developing cartridge 14 and toner life-span information about life-span of the developing cartridge 14 are stored. The toner identification information is, for example, a serial number. The toner life-span information is at least one of the number of rotations of the developing roller 17, the number of prints of the developing roller 17, and the number of output dots. In a state in which the developing cartridge 14 is inserted to the drawer 10, the toner memory 15 of the present illustrative embodiment is positioned on an outer surface of the side plate 132, which is located on the other side in the first direction, of the pair of side plates 132.

As shown in FIG. 3, the drawer-side connector 16 is located on an outer surface of the base plate 131, which is located at one side in the second direction, of the pair of the base plates 131. The drawer-side connector 16 includes a drawer-side electrical contact part 161, and a drawer-side holder 162. A plurality of electrical contact surfaces is aligned on the drawer-side electrical contact part 161. Any one of wirings such as a voltage line, a clock line, a data line and the like extends on each of the electrical contact surfaces, and the wirings are connected to the drum memory 13. Also, the wirings are electrically connected to the corresponding toner memories 15 via the drum memory 13. The wirings are appropriately bundled to form a harness. In this way, the drawer-side electrical contact part 161 is electrically connected to the drum memory 13 and the toner memories 15.

When the drawer-side connector 16 is connected to the main body-side connector 65, which will be described later, the drum memory 13 and toner memories 15, and the controller 64 are electrically connected. Thereby, the controller 64 can perform communication with the drum memory 13 and the toner memories 15.

The drawer-side holder 162 shown in FIG. 3 extends in the third direction. The drawer-side holder 162 is configured to hold therein the drawer-side electrical contact part 161. That is, the drawer-side holder 162 is configured to surround the drawer-side electrical contact part 161. The drawer-side holder 162 has such a shape that it gradually converges as it comes closer to the drawer-side electrical contact part 161 in the third direction. In other words, the drawer-side holder 162 becomes wider so that it is more distant from the drawer-side electrical contact part 161 toward one side in the third direction.

<1-3-2. Configuration Relating to Electrical Connection of Image Forming Apparatus Main Body>

Figure 5:
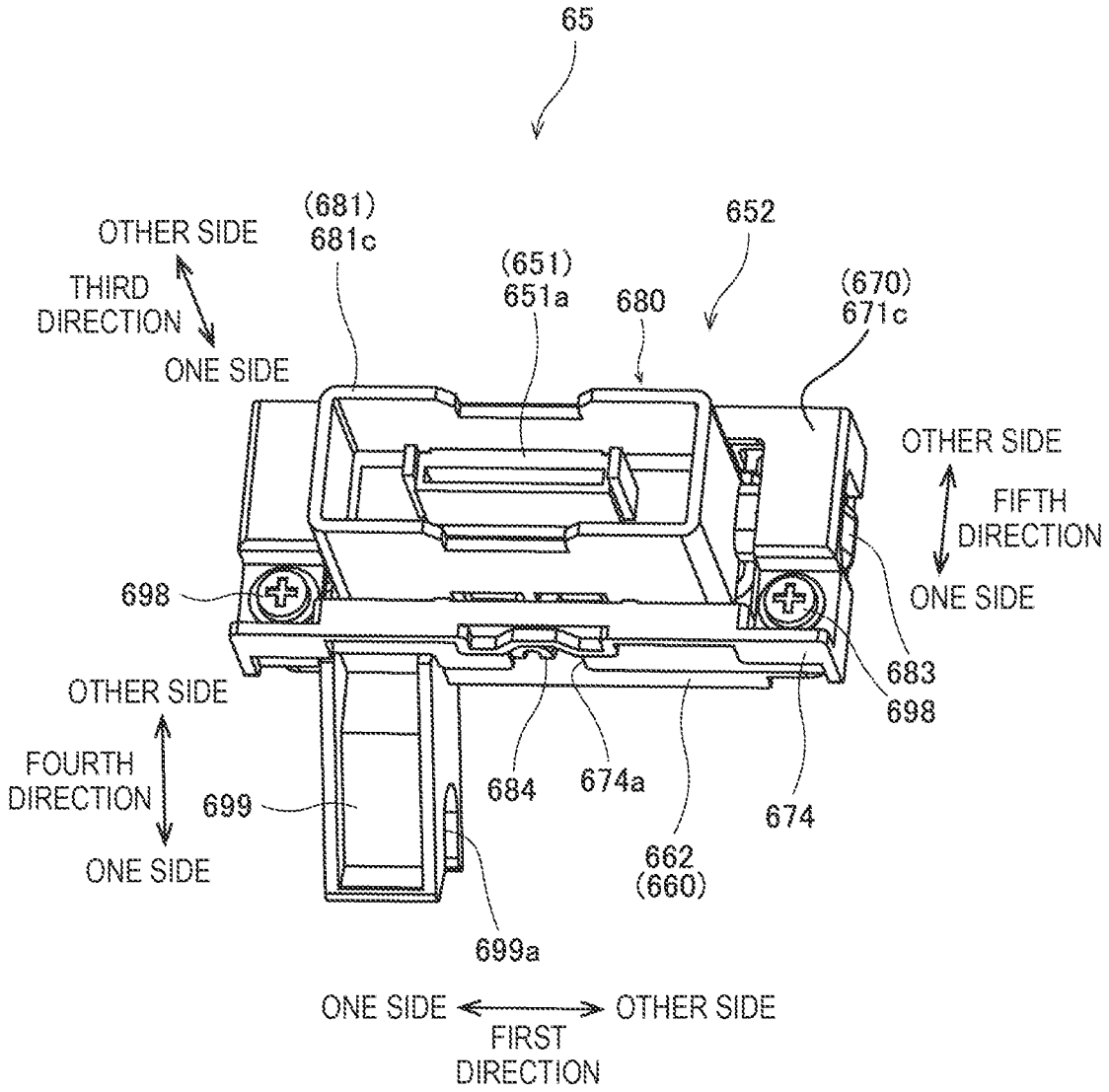
FIG. 5 is a perspective view of a main body-side connector.

FIG. 5 is a perspective view of the main body-side connector 65. As shown in FIG. 5, the main body-side connector 65 includes a main body-side electrical contact part 651, and a main body-side holder 652. A plurality of electric contact points is aligned at the main body-side electrical contact part 651. From each of the electric contact points, any one of wirings such as a voltage line, a clock line, a data line and the like extends. The wirings are connected to corresponding terminals of the controller 64. The wirings are appropriately bundled to form a harness. In this way, the main body-side electrical contact part 651 is electrically connected to the controller 64.

When the drawer 10 is inserted into the internal space 610 of the housing 61 and is thus arranged in the installation position, the main body-side connector 65 and the drawer-side connector 16 are interconnected. Thereby, each electrical contact surface of the drawer-side electrical contact part 161 is contacted to the corresponding electric contact point of the main body-side electrical contact part 651.

The main body-side holder 652 is configured to hold the main body-side electrical contact part 651 so as to be movable, i.e., floatable in the third direction and in a direction perpendicular to the third direction. The direction perpendicular to the third direction is, for example, the fifth direction. The specific configuration of the main body-side holder 652 will be described later.

In the image forming apparatus 100 configured as described above, upon execution of printing processing, the controller 64 is configured to drive a motor (not shown). The photosensitive drums 11 and the developing rollers 17 are configured to rotate by drive of the motor. Also, the controller 64 is configured to electrically charge surfaces of the photosensitive drums 11 by feeding power to the chargers. Also, the controller 64 is configured to cause the light sources to emit lights, thereby irradiating the lights from the light sources toward the outer peripheral surfaces of the photosensitive drums 11. Thereby, electrostatic latent images of an image to be printed are formed on the outer peripheral surfaces of the photosensitive drums 11. The toners of the developing cartridges 14 are supplied onto the electrostatic latent images on the photosensitive drums 11 via the developing rollers 17. Thereby, toner images are formed on the outer peripheral surfaces of the photosensitive drums 11. Thereafter, the print sheet is conveyed between the photosensitive drums 11 and the transfer belt 63. Thereby, the toner images are transferred from the outer peripheral surfaces of the photosensitive drums 11 to the print sheet. In the state in which the toner images have been transferred to the print sheet, the print sheet is conveyed to a fixing device in the image forming apparatus 100. Thereby, the toner images transferred to the print sheet are heat-fixed on the print sheet. As a result, an image is printed on the print sheet.

In the meantime, upon execution of the printing processing, the controller 64 is configured to perform communication with the drum memory 13 and the toner memories 15, thereby acquiring the information about the life-span of the photosensitive drums 11 and the life-span of the developing cartridges 14, for example. Thereby, the controller 64 can set a favorable mode to execute the printing processing or stop the printing processing, depending on situations.

<1-4. Detailed Configurations of Respective Components of Main Body-Side Connector>

In the below, a configuration of the main body-side connector 65, particularly, a detailed description of the main body-side holder 652 are described with reference to FIGS. 5 to 18. As shown in FIG. 5, the main body-side holder 652 includes a base 660, a cover 670, a panel 680, and coil springs (elastic member) 690 (refer to FIG. 6).

<1-4-1. Configuration of Base>

Figure 6:
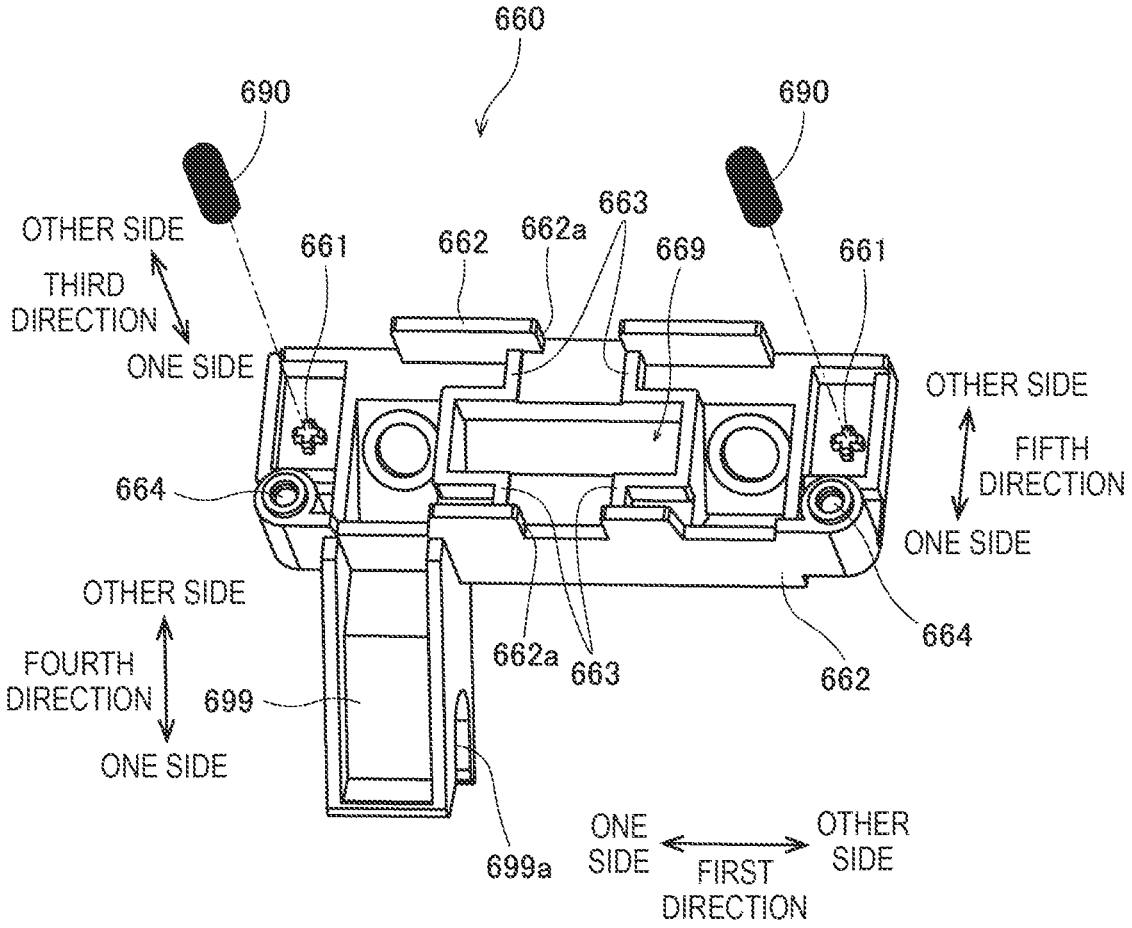
FIG. 6 is a perspective view of a base.
Figure 7:
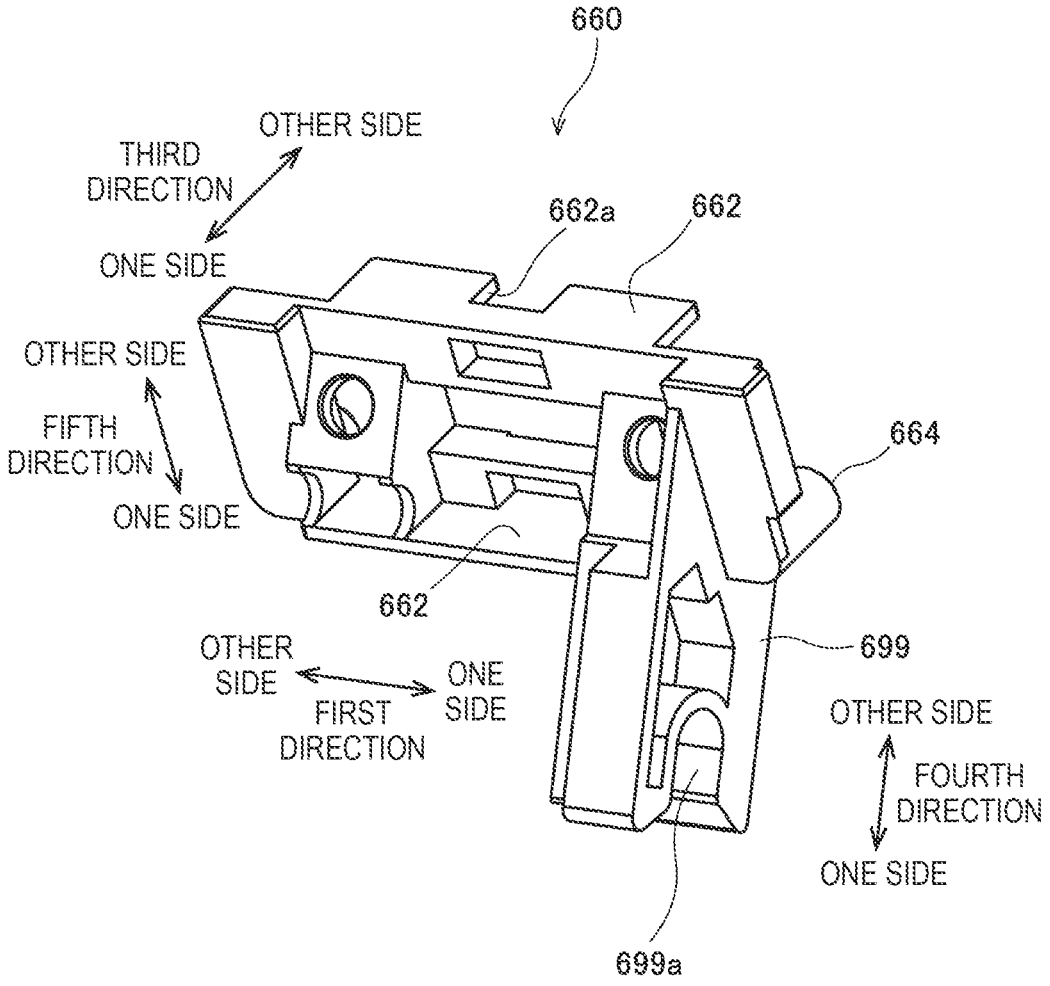
FIG. 7 is a perspective view of the base.

First, a configuration of the base 660 is described with reference to FIGS. 6 and 7. FIG. 6 is a perspective view of the base 660 and the coil springs 690. FIG. 7 is a perspective view of the base 660, as seen in a direction different from FIG. 6.

The base 660 has a rectangular shape, as seen in the third direction. The base 660 has an attachment part 699. As described in detail later, the attachment part 699 is used to attach the base 660 to the reference shaft 67 extending in the first direction in the internal space 610 of the housing 61. The base 660 has a through-hole 669 penetrating a central portion of the rectangular shape in the third direction. An inner peripheral surface of the through-hole 669 has a rectangular shape having long sides and short sides, as seen in the third direction.

The base 660 has first spring seats 661 on an outer surface on the other side in the third direction. One end of the coil spring 690 (which will be described later) in the third direction is connected to the first spring seat 661. The first spring seats 661 are arranged at two places, i.e., one side of the through-hole 669 in the first direction and the other side of the through-hole 669 in the first direction with the through-hole 669 being interposed therebetween.

The base 660 has a pair of end walls 662 facing each other in the fifth direction. Each end wall 662 extends perpendicularly to the fifth direction. A central portion of the end wall 662 in the first direction is provided with a rectangular notch 662*a* opening toward the other side in the third direction.

Also, the base 660 has a first contact surface 663 protruding in a rib shape on the outer surface on the other side in the third direction. The first contact surface 663 is a flat surface-shaped part perpendicular to the third direction. The first contact surface 663 extends in the fifth direction from parts of the long sides of the through-hole 669. The first contact surface 663 more protrudes toward the other side in the third direction than a region adjacent in the first direction.

Also, the base 660 has opened screw holes 664 on the outer surface on the other side in the third direction. The screw hole 664 extends toward one side in the third direction. The screw hole 664 has a female screw on an inner peripheral surface thereof <1-4-2. Configuration of Cover>

Figure 8:
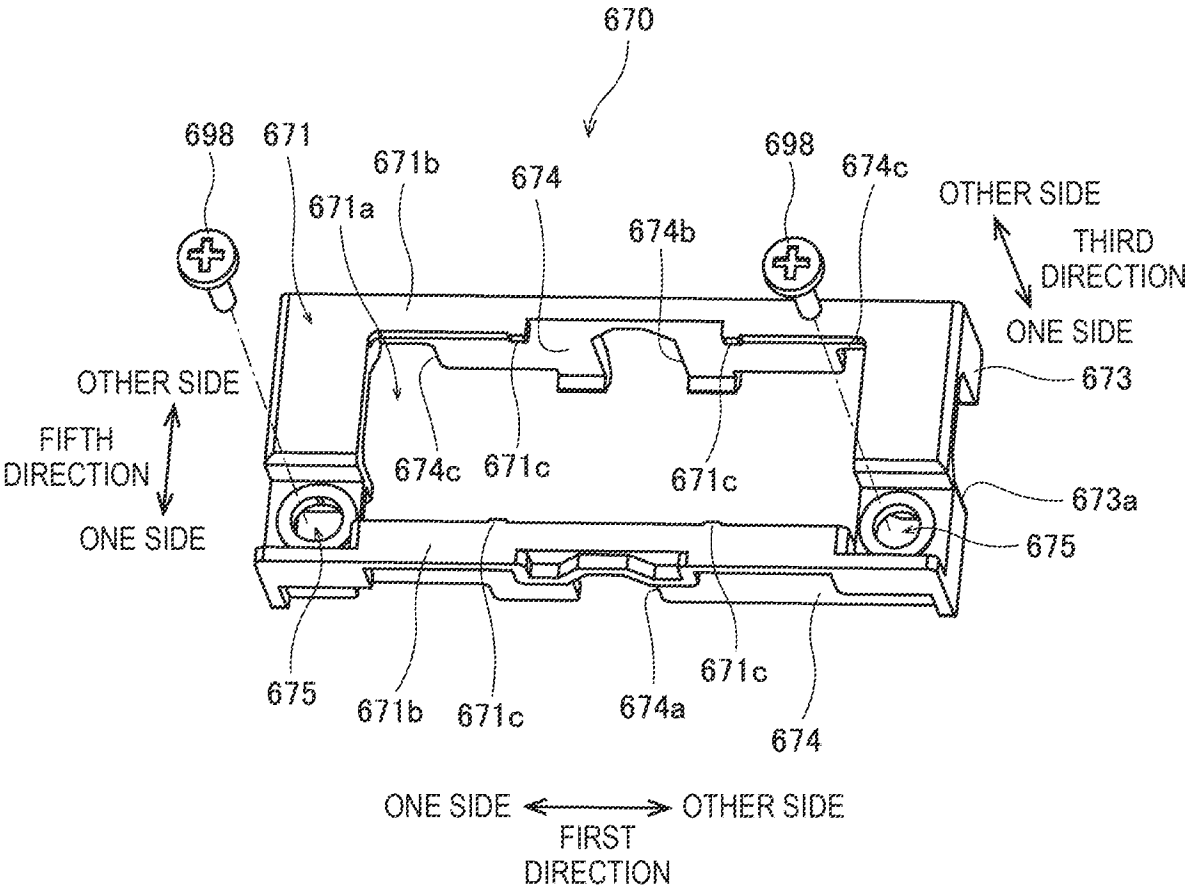
FIG. 8 is a perspective view of a cover.
Figure 9:
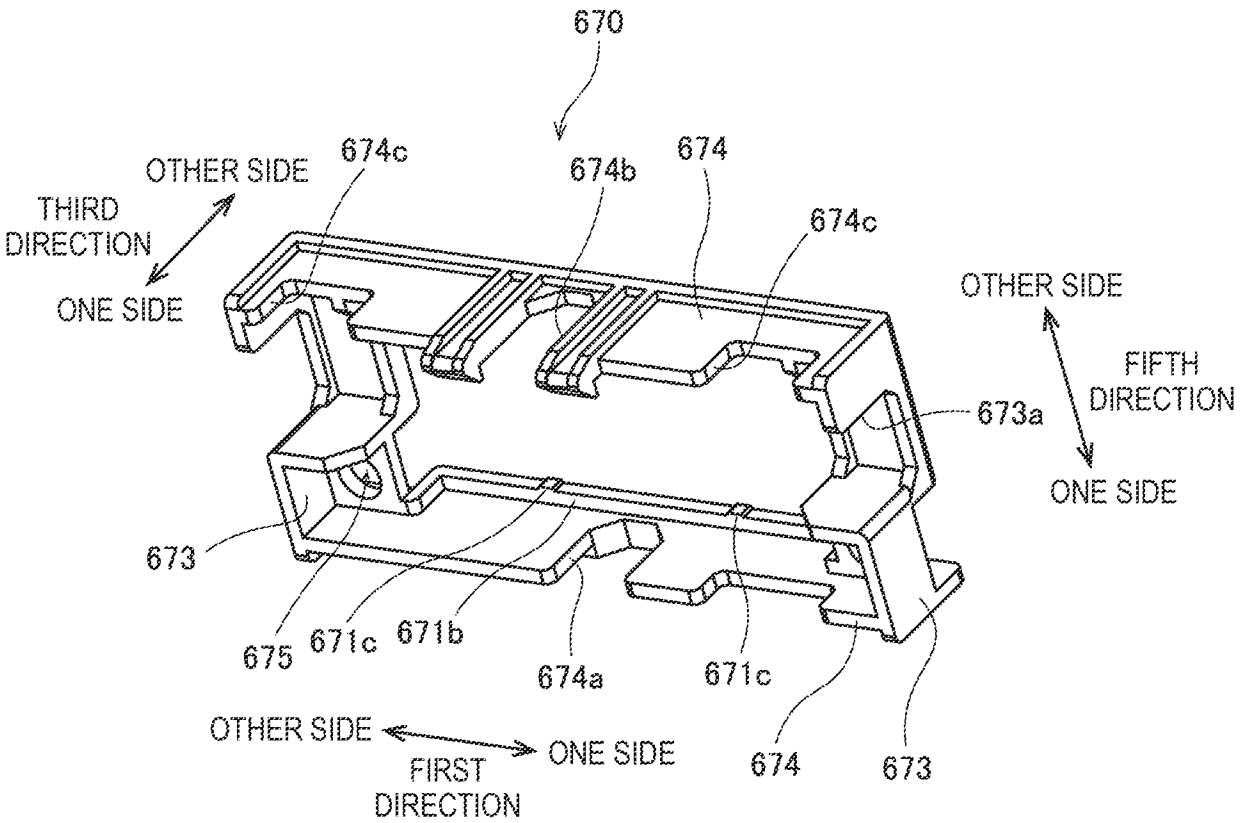
FIG. 9 is a perspective view of the cover.

Subsequently, a configuration of the cover 670 is described with reference to FIGS. 8 and 9. FIG. 8 is a perspective view of the cover 670 and screws 698. FIG. 9 is a perspective view of the cover 670, as seen in a direction different from FIG. 8.

The cover 670 has a rectangular frame shape, as seen in the third direction. The cover 670 has a frame part 671, a pair of first sidewalls 673, and a pair of second sidewalls 674. The frame part 671 has a rectangular outer shape, and is formed at its central part with a through-hole 671*a*. An inner peripheral surface of the through-hole 671*a* has a rectangular shape having long sides and short sides conforming to the outer shape of the frame part 671.

The pair of first sidewalls 673 is spaced in the first direction. The first sidewall 673 has a plate shape perpendicular to the first direction. The first sidewall 673 extends from a short side part of an outer edge of the frame part 671 toward one side in the third direction. The pair of second sidewalls 674 is spaced in the fifth direction. The second sidewall 674 has a plate shape perpendicular to the fifth direction. The second sidewall 674 extends from a long side part of the outer edge of the frame part 671 toward one side in the third direction.

The frame part 671 has a pair of through-holes 675. The through-hole 675 is formed to penetrate the frame part 671 in the third direction. As described later, the cover 670 is fixed to the base 660 with being overlapped in the third direction. The through-holes 675 are provided in positions corresponding to the screw holes 664 of the base 660. In the through-hole 675, a shaft part of the screw 698 can be inserted. When the frame part 671 is seen from the other side in the third direction, a region in which the through-hole 675 of the frame part 671 is formed is more recessed than the other region toward one side in the third direction.

A second sidewall 674, which is located at one side in the fifth direction, of the pair of second sidewalls 674 has a first notch 674*a* opening toward one side in the third direction. The first notch 674*a* is provided at a central portion in the first direction of the second sidewall 674 located on one side in the fifth direction. A width of the first notch 674*a* in the first direction gradually decreases toward the other side in the third direction. That is, the width of the first notch 674*a* in the first direction decreases away from the base 660 in the third direction.

In the present illustrative embodiment, a second sidewall 674, which is located on the other side in the fifth direction, of the pair of second sidewalls 674 has a notch 674*b* opening toward one side in the third direction. When seen in the fifth direction, the notch 674*b* is provided with being overlapped with the first notch 674*a*. Also, the second sidewall 674 has second notches 674*c* provided in positions on both sides in the first direction away from a position (a position of the notch 674*b*) facing the first notch 674*a*. When seen in the fifth direction, the second notches 674*c* are provided in a pair with the notch 674*b* being interposed therebetween. The second notch 674*c* opens toward one side in the third direction. The second notch 674*c* has a rectangular shape, as seen in the fifth direction.

When seen in the third direction, the first notch 674*a* and the pair of second notches 674*c* are respectively arranged at apexes of a virtual isosceles triangle.

The first sidewalls 673 have third notches 673*a* opening toward one side in the third direction. The third notches 673*a* are provided in a pair on the first sidewalls 673 facing each other. The third notch 673*a* has a rectangular shape, as seen in the first direction.

Specifically, the frame part 671 of the cover 670 includes a flat surface 671*b*, and protrusions 671*c*. The flat surface 671*b* has a rectangular shape extending from end portions of the second sidewalls 674 at an opposite side (other side) to the base 660 in the third direction toward an inside of the cover 670 in the fifth direction. The protrusions 671*c* partially protrude from an inner edge of the flat surface 671*b* toward the inside of the cover 670 in the fifth direction. When seen in the third direction, the protrusions 671*c* are provided at four places on both sides in the first direction with the notches 674*a* and 674*b* being interposed therebetween. The four the protrusions 671*c* are respectively arranged at apexes of a virtual rectangle, as seen in the third direction.

<1-4-3. Configuration of Panel>

Figure 10:
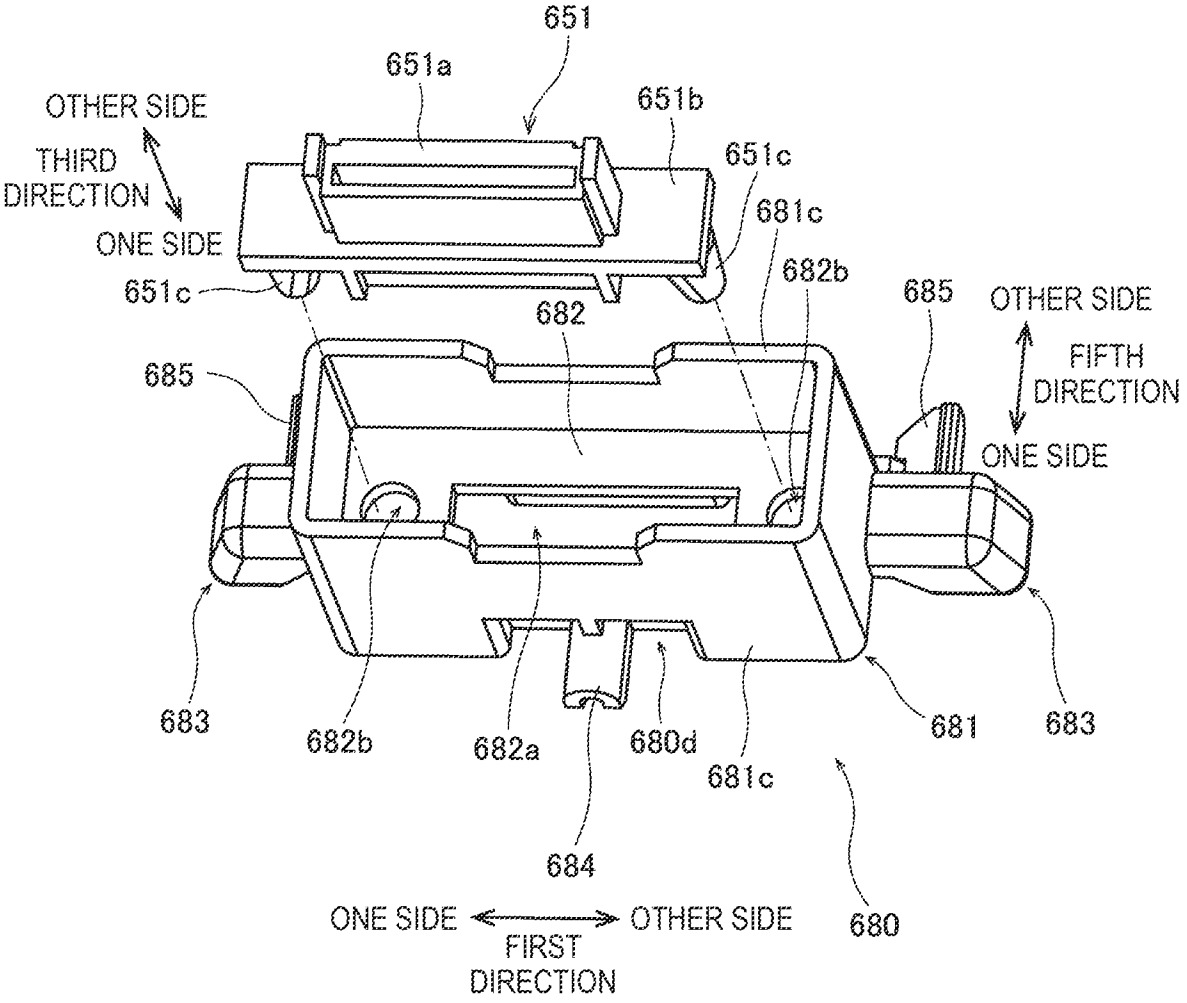
FIG. 10 is an exploded perspective view of a panel and a main body-side electrical contact part.
Figure 11:
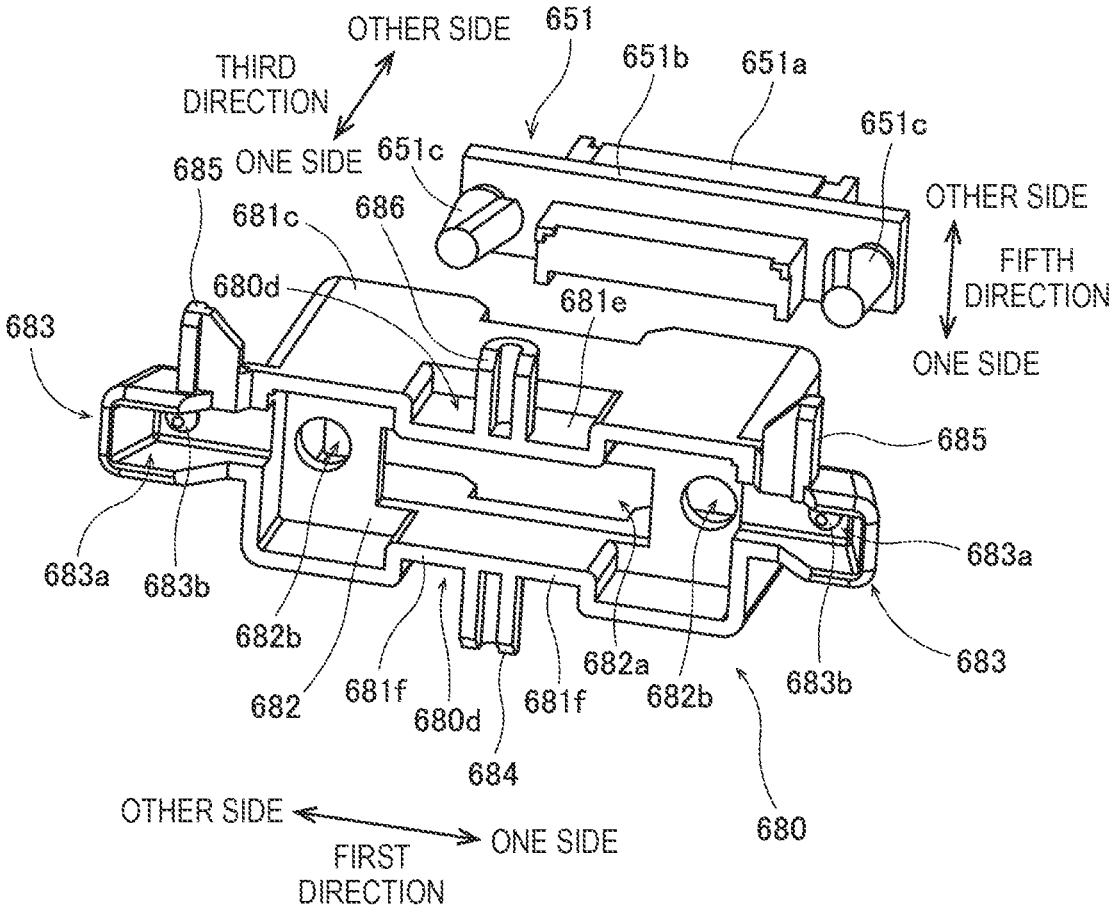
FIG. 11 is an exploded perspective view of the panel and the main body-side electrical contact part.

Subsequently, a configuration of the panel 680 is described with reference to FIGS. 10 and 11. FIG. 10 is a perspective view of the panel 680 and the main body-side electrical contact part 651. FIG. 11 is a perspective view of the panel 680 and the main body-side electrical contact part 651, as seen in a direction different from FIG. 10.

The panel 680 includes a box body 681, and a partitioning plate 682. The box body 681 has a square tube shape, and extends in the third direction. The box body 681 has a substantially rectangular outer shape, as seen in the third direction. The partitioning plate 682 has a rectangular plate shape perpendicular to the third direction. The partitioning plate 682 extends from an inner surface of a part of the box body 681 in the third direction toward an inside of the box body 681. The partitioning plate 682 is formed at a central part with a rectangular through-hole 682*a* conforming to the outer shape of the partitioning plate 682.

Through-holes (attachment part) 682*b* are arranged at both sides of the partitioning plate 682 in the first direction with the through-hole 682*a* being interposed therebetween. An inner peripheral surface of the through-hole 682*b* has a circular shape, as seen in the third direction. The main body-side electrical contact part 651 is attached into the through-holes 682*b* from the other side in the third direction.

The panel 680 has a pair of ear parts 683 extending outside of the panel 680 from both sides of the box body 681 in the first direction. The ear parts 683 are arranged at both sides in the first direction with the through-hole 682*a* and the through-holes 682*b* being interposed therebetween.

As shown in FIG. 11, the ear part 683 has therein a void. In other words, the ear part 683 has a concave portion 683*a* opening toward the base 660. The ear part 683 has a second spring seat 683*b* at a bottom of the concave portion 683*a*. That is, the second spring seat 683*b* is provided inside of the concave portion 683*a*. The spring seat 683*b* is connected with the other end of the coil spring 690 in the third direction.

End portions, which are located at one side in the third direction, of a pair of sidewalls 681*c*, which are perpendicular to the fifth direction, of sidewalls of the box body 681 have a concave portion 680*d*, respectively. The concave portion 680*d* is recessed from the sidewall 681*c* toward a radially inward side of the box body 681. A bottom of the concave portion 680*d* is configured as a flat surface portion 681*e* perpendicular to the fifth direction. An end face of the flat surface portion 681*e* on one side in the third direction continues to an end face of the box body 681 on one side in the third direction. The end face of the flat surface portion 681*e* at one side in the third direction is configured as a second contact surface 681*f*. As described later, the second contact surface 681*f* is contactable the first contact surface 663 of the base 660.

Also, the box body 681 has a first protrusion 684, a pair of second protrusions 685, and a third protrusion 686. The first protrusion 684 extends from the concave portion 680*d*, which is located at one side in the fifth direction, of the pair of concave portions 680*d* toward an outside of the box body 681. That is, the first protrusion 684 extends toward one side in the fifth direction. The second protrusions 685 extend from the pair of ear parts 683 toward the other side in the fifth direction, respectively. Also, the third protrusion 686 extends from the concave portion 680*d*, which is located at the other side in the fifth direction, of the pair of concave portions 680*d* toward an outside of the box body 681. That is, the third protrusion 686 extends toward the other side in the fifth direction.

The first protrusion 684 and the third protrusion 686 have a semicircular section, when taken along a section perpendicular to the fifth direction, respectively. The semicircular section has an open end directed to one side in the third direction. That is, outer surfaces of the first protrusion 684 and the third protrusion 686 have a semicircular shape of which a width in the first direction gradually decreases toward the other side in the third direction, as seen in the fifth direction.

<1-4-4. Configuration of Coil Spring>

The coil spring 690 is an elastic member of which a metal line is wound in a spiral shape. The coil spring 690 is interposed between the base 660 and the panel 680. The coil spring 690 is extendable and contractable in the third direction. Also, the coil spring 690 is bendable in a radial direction of the spiral. As described later, the coil spring 690 is arranged between the first spring seat 661 of the base 660 and the second spring seat 683*b* of the ear part 683 of the panel 680 in a state in which it is compressed more than a natural length.

<1-5. Configuration of Main Body-Side Electrical Contact Part>

In the below, a configuration of the main body-side electrical contact part 651 is described with reference to FIGS. 10 and 11. The main body-side electrical contact part 651 has a female connector terminal 651*a*, a connector terminal support 651*b*, and a pair of shaft parts 651*c*.

The female connector terminal 651*a* is arranged therein with the plurality of electric contact points. The connector terminal support 651*b* is a rectangular plate-shaped part perpendicular to the third direction. The female connector terminal 651*a* is fixed to a central part of the connector terminal support 651*b*. The pair of shaft parts 651*c* is positioned on an end face of the connector terminal support 651*b* on one side in the third direction. The shaft parts 651*c* are arranged at both sides in the first direction with the female connector terminal 651*a* being interposed therebetween.

The shaft part 651*c* has a conical shape, and protrudes from the connector terminal support 651*b* toward one side in the third direction. The shaft part 651*c* is formed of an elastic material. The shaft part 651*c* can be contracted radially as a result of operator's pressing.

<1-6. Attachment Configuration of Respective Parts of Main Body-Side Connector>

Figure 12:
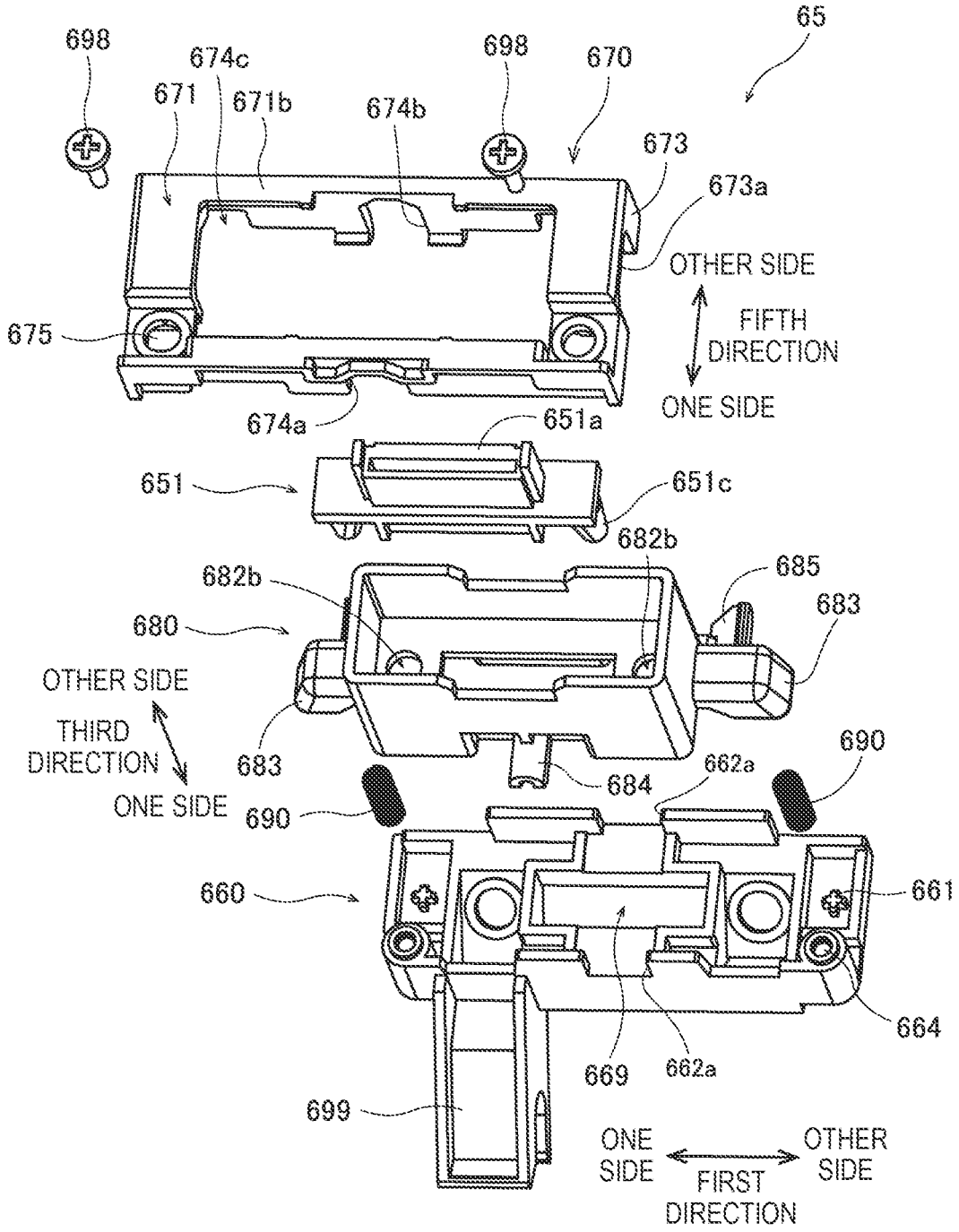
FIG. 12 is an exploded perspective view of the main body-side connector.
Figure 13:
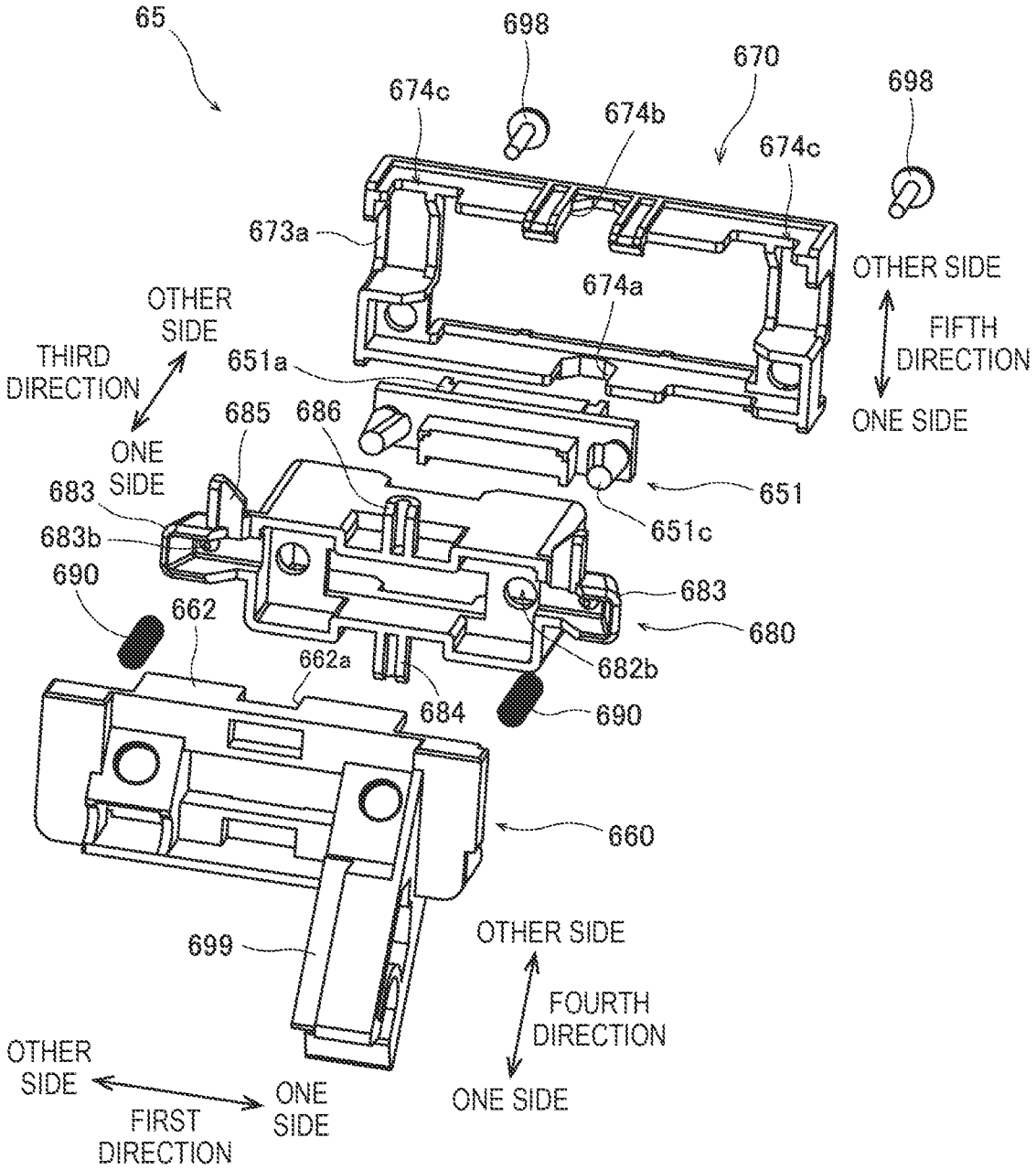
FIG. 13 is an exploded perspective view of the main body-side connector.

In the below, an attachment aspect of the base 660, the cover 670, the panel 680, the coil springs 690, the screws 698, and the main body-side electrical contact part 651 is described with reference to FIGS. 12 and 13. FIG. 12 is an exploded perspective view of the main body-side connector 65. FIG. 13 is an exploded perspective view of the main body-side connector 65, as seen in a direction different from FIG. 12.

First, an operator in a factory for manufacturing the image forming apparatus 100 inserts the shaft parts 651*c* of the main body-side electrical contact part 651 into the through-holes 682*b* of the partitioning plate 682 of the panel 680 while pressing the shaft parts 651*c*. Thereby, the main body-side electrical contact part 651 is attached to the panel 680. The shaft parts 651*c* expand radially outward after passing through the through-holes 682*b*. Thereby, the main body-side electrical contact part 651 cannot be separated from the partitioning plate 682 of the panel 680.

The panel 680 having the main body-side electrical contact part 651 attached thereto is partially sandwiched between the base 660 and the cover 670. Specifically, one ends of the pair of coil springs 690 are respectively attached to the first spring seats 661 of the base 660. In this state, the panel 680 is overlapped over the base 660 from the other side in the third direction. At this time, the other ends of the coil springs 690 are attached to the second spring seats 683*b* of the ear parts 683 of the panel 680. Also, the first protrusion 684 of the panel 680 is accommodated in the notch 662*a* of the base 660 on one side in the fifth direction. Also, the pair of second protrusions 685 of the panel 680 is arranged on both sides of the end wall 662 in the first direction while sandwiching the end wall 662 on the other side in the fifth direction therebetween. The third protrusion 686 of the panel 680 is accommodated in the notch 662*a* of the base 660 on the other side in the fifth direction.

As shown in FIGS. 12 and 13, the cover 670 is further overlapped over the base 660 having the panel 680 overlapped thereon, from the other side in the third direction. At this time, the first protrusion 684 of the panel 680 is accommodated in the first notch 674*a* of the cover 670. The pair of second protrusions 685 of the panel 680 is accommodated in the second notches 674*c* of the cover 670. The third protrusion 686 of the panel 680 is accommodated in the notch 674*b* of the cover 670. The pair of ear parts 683 of the panel 680 is accommodated in the pair of third notches 673*a* of the cover 670. In this state, the shaft parts of the screws 698 are inserted into the through-holes 675 of the cover 670 from the other side in the third direction, and are screwed into the screw holes 664 of the base 660. Thereby, the cover 670 is fixed to the base 660 while sandwiching the coil springs 690 and the panel 680 therebetween.

<1-7. Movement of Connector>

Figure 14:
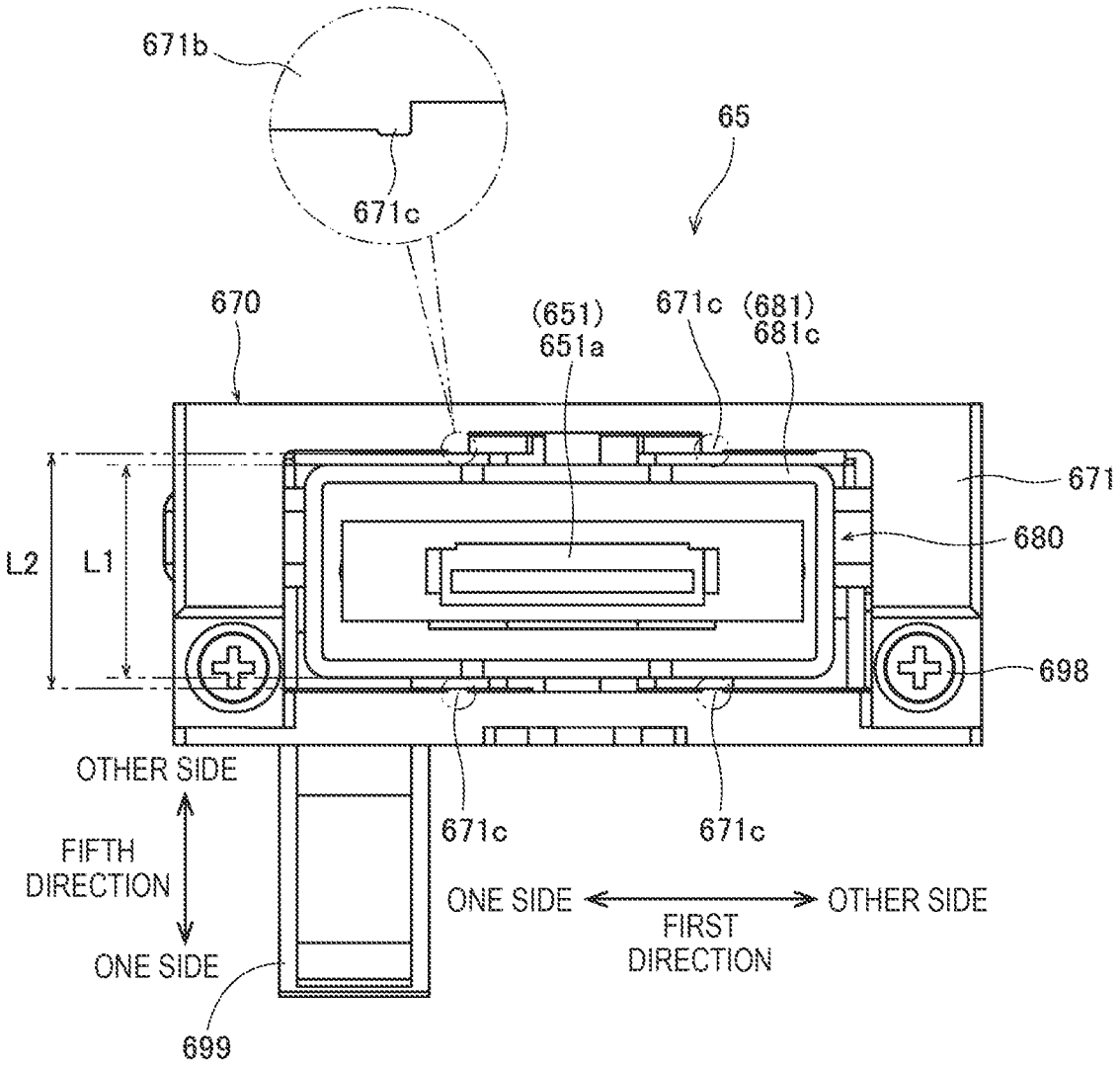
FIG. 14 depicts the main body-side connector, as seen from the other side in a third direction.
Figure 15:
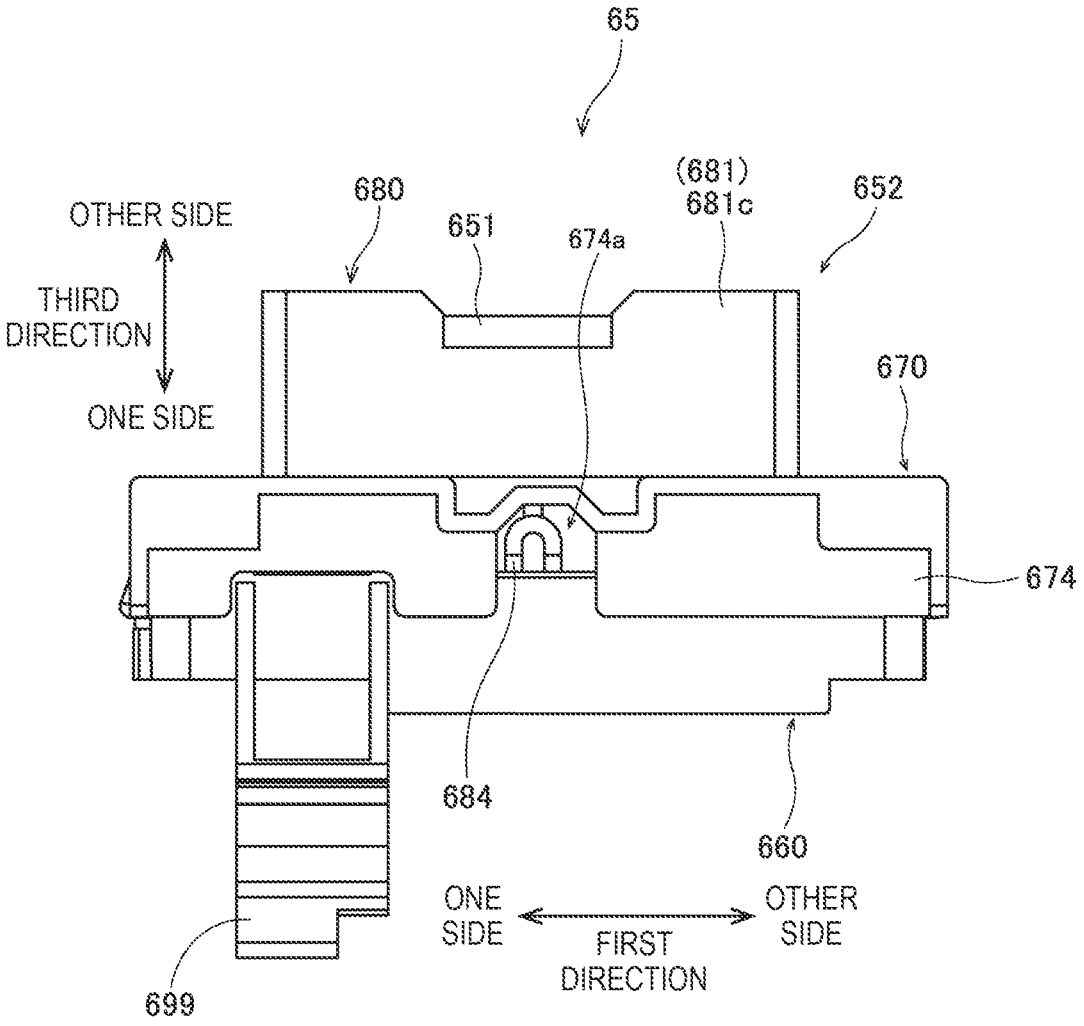
FIG. 15 depicts the main body-side connector, as seen from one side in a fifth direction.
Figure 16:
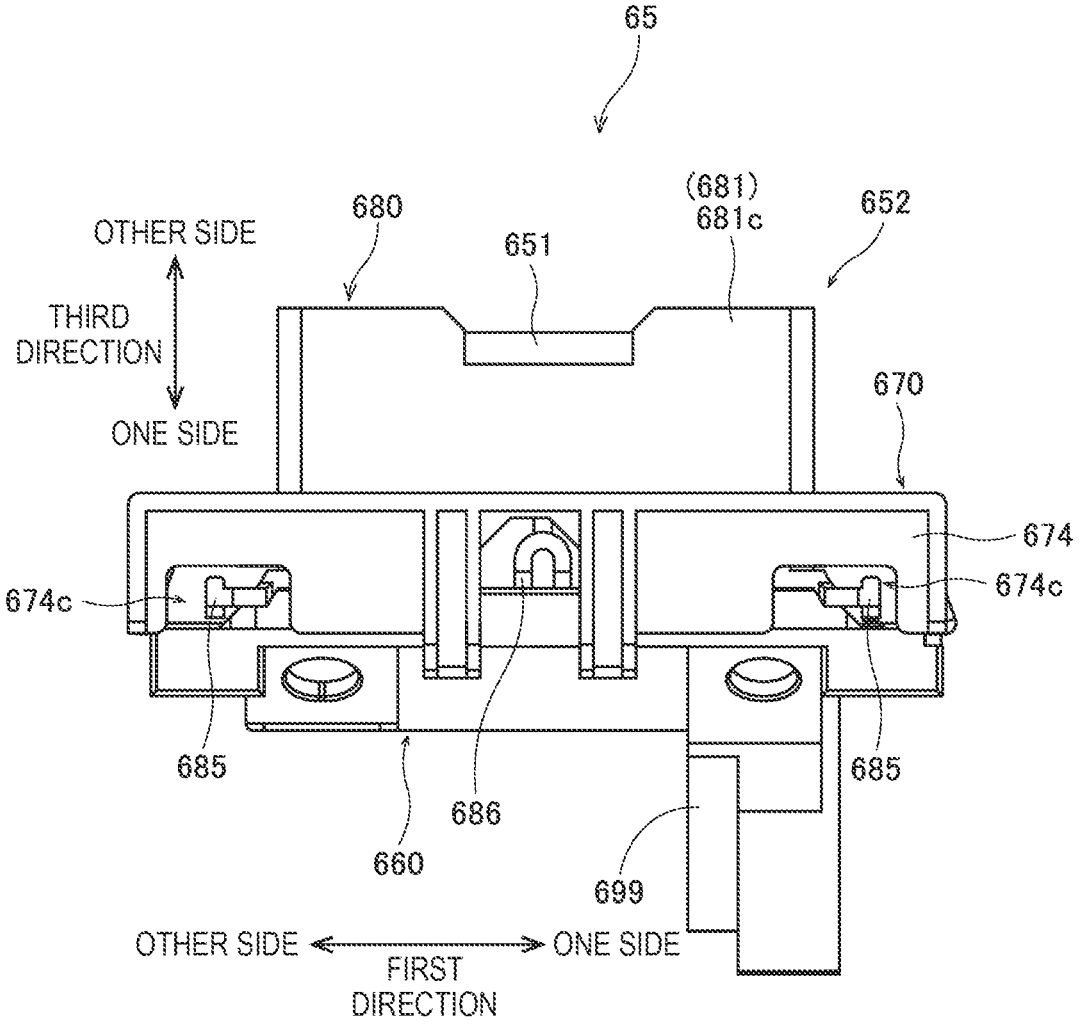
FIG. 16 depicts the main body-side connector, as seen from the other side in the fifth direction.
Figure 17:
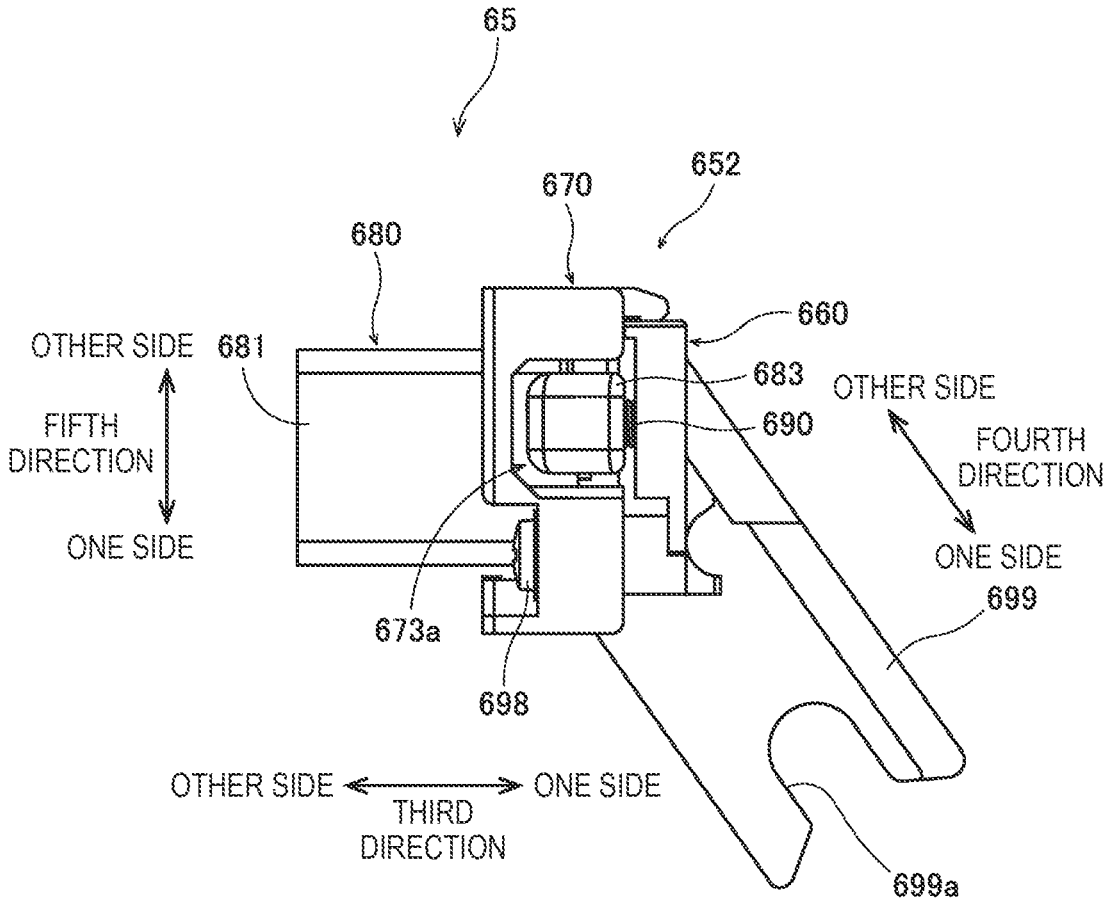
FIG. 17 depicts the main body-side connector, as seen from the other side in a first direction.
Figure 18:
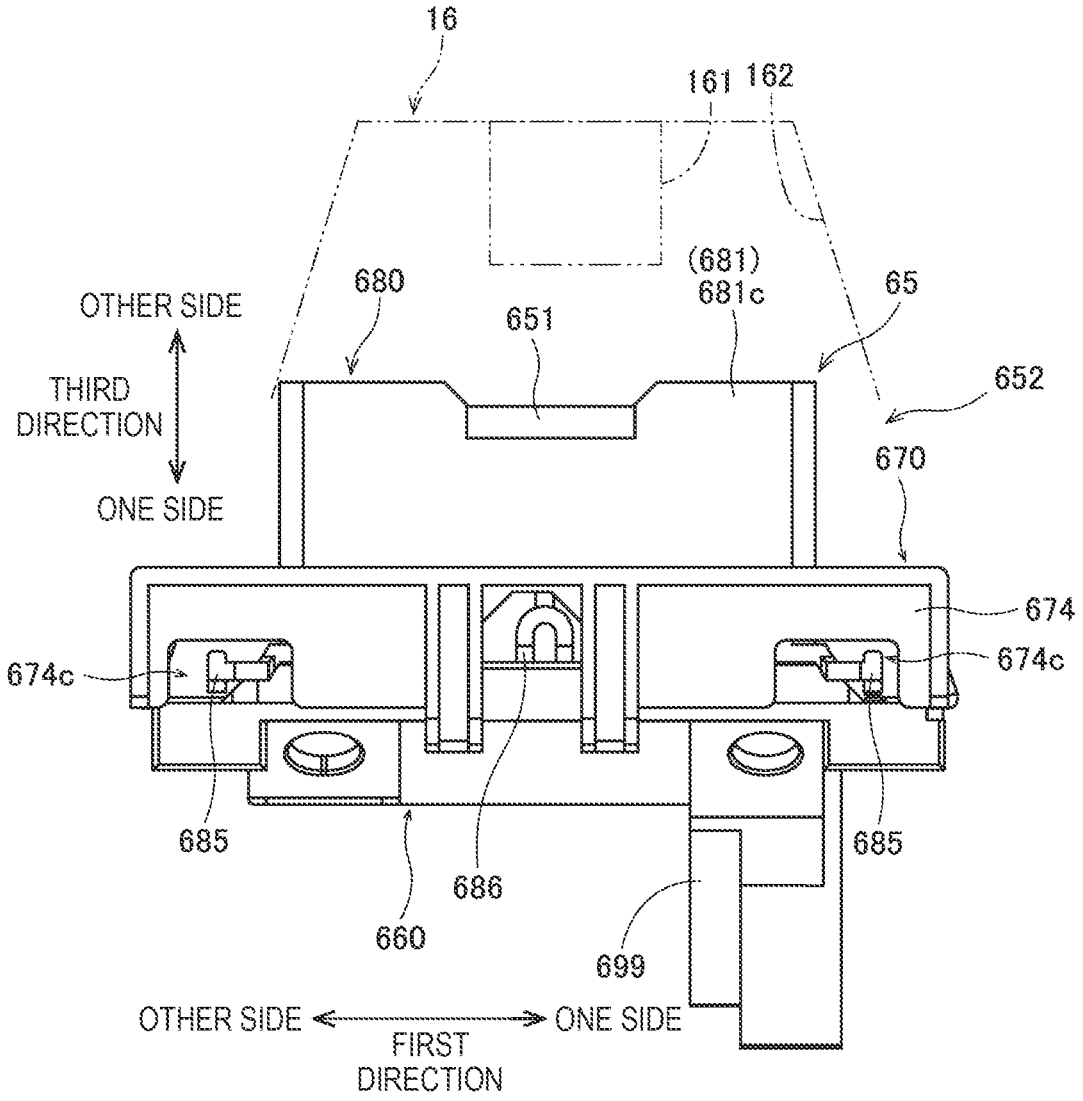
FIG. 18 is a pictorial view depicting an aspect in which a drawer-side holder is in contact with a part of a main body-side holder.

In the below, movement of the main body-side connector 65 attached as described above is described with reference to FIGS. 14 to 18. FIG. 14 depicts the main body-side connector 65, as seen from the other side in the third direction. FIG. 15 depicts the main body-side connector 65, as seen from one side in the fifth direction. FIG. 16 depicts the main body-side connector 65, as seen from the other side in the fifth direction. FIG. 17 depicts the main body-side connector 65, as seen from the other side in the first direction. FIG. 18 depicts an aspect in which the drawer-side holder 162 is in contact with a part of the main body-side holder 652.

In the main body-side connector 65, the coil springs 690 are held compressed more than a natural length between the base 660 and the panel 680. Therefore, the main body-side electrical contact part 651 is always compressed toward the other side in the third direction. However, the first protrusion 684 is moved only within a range surrounded by the notch 662*a* and the first notch 674*a*, and the second protrusions 685 are moved only within a range surrounded by the second notches 674*c*, so that a position of the main body-side electrical contact part 651 in the third direction is constant in a state in which it is not in contact with the drawer-side electrical contact part 161.

However, the coil springs 690 are held in a state in which there is an allowance for contraction toward one side in the third direction. For this reason, as shown in FIG. 18, when the main body-side connector 65 is applied with external force as a result of contact of the panel 680 (the box body 681) to the drawer-side holder 162, for example, the coil springs 690 are deformed and the position of the main body-side electrical contact part 651 can be thus correspondingly displaceable in the third direction, and in the direction perpendicular to the third direction. That is, the main body-side electrical contact part 651 is floated with respect to a part (the base 660 and the cover 670) of the main body-side holder 652.

Also, as shown in FIG. 15, in the main body-side connector 65, a gap is formed in the first direction between an outer surface of the first protrusion 684 and an inner surface of the first notch 674*a*. Also, as shown in FIG. 16, a gap is formed in the first direction between an outer surface of the second protrusion 685 and an inner surface of the second notch 674*c*. Therefore, even when the main body-side connector 65 is applied with the external force as a result of contact of the panel 680 (the box body 681) to the drawer-side holder 162, for example, the first protrusion 684 is moved only within the first notch 674*a* and the second protrusion 685 is moved only within the second notch 674*c*, so that a movement range of the main body-side electrical contact part 651 in the first direction is restrained.

Also, as shown in FIG. 14, in the main body-side connector 65, a spacing distance L2 between the protrusions 671*c* facing each other in the fifth direction is greater than a distance L1 between the outer surfaces of the sidewalls 681*c*, which face each other in the fifth direction, of the panel 680 (L1<L2). In other words, a gap is formed in the fifth direction between an outer surface of the box body 681 of the panel 680 and an inner edge surface of the protrusion 671*c*. Therefore, even when the main body-side connector 65 is applied with the external force as a result of contact of the panel 680 to the drawer-side holder 162, for example, the outer surface of the sidewall 681*c* of the panel 680 is moved only to a position in which it contacts any one of the protrusions 671*c* facing in the fifth direction, so that the movement range of the main body-side electrical contact part 651 in the fifth direction is restrained.

Also, as shown in FIG. 17, the ear part 683 extends in the first direction through the third notch 673*a*. Thereby, the panel 680 is pressed by the coil springs 690 in outermore positions of the base 660 and the panel 680 in the first direction. As a result, a posture of the main body-side electrical contact part 651 is more stabilized.

Also, in the main body-side connector 65, even if the coil springs 690 are compressed by the entire allowance due to a shock upon the contact of the drawer-side electrical contact part 161 to the main body-side electrical contact part 651, for example, the first contact surface 663 of the base 660 and the second contact surface 681*f* of the box body 681 of the panel 680 are contacted to each other. In other words, the main body-side connector 65 is bottomed. In this way, the main body-side connector 65 is configured to be elastically deformable in the third direction, so that excessive load is prevented from being applied to the coil springs 690 and the like.

<1-8. Positioning Structures of Drawer and Sheet Discharger>

Figure 19:
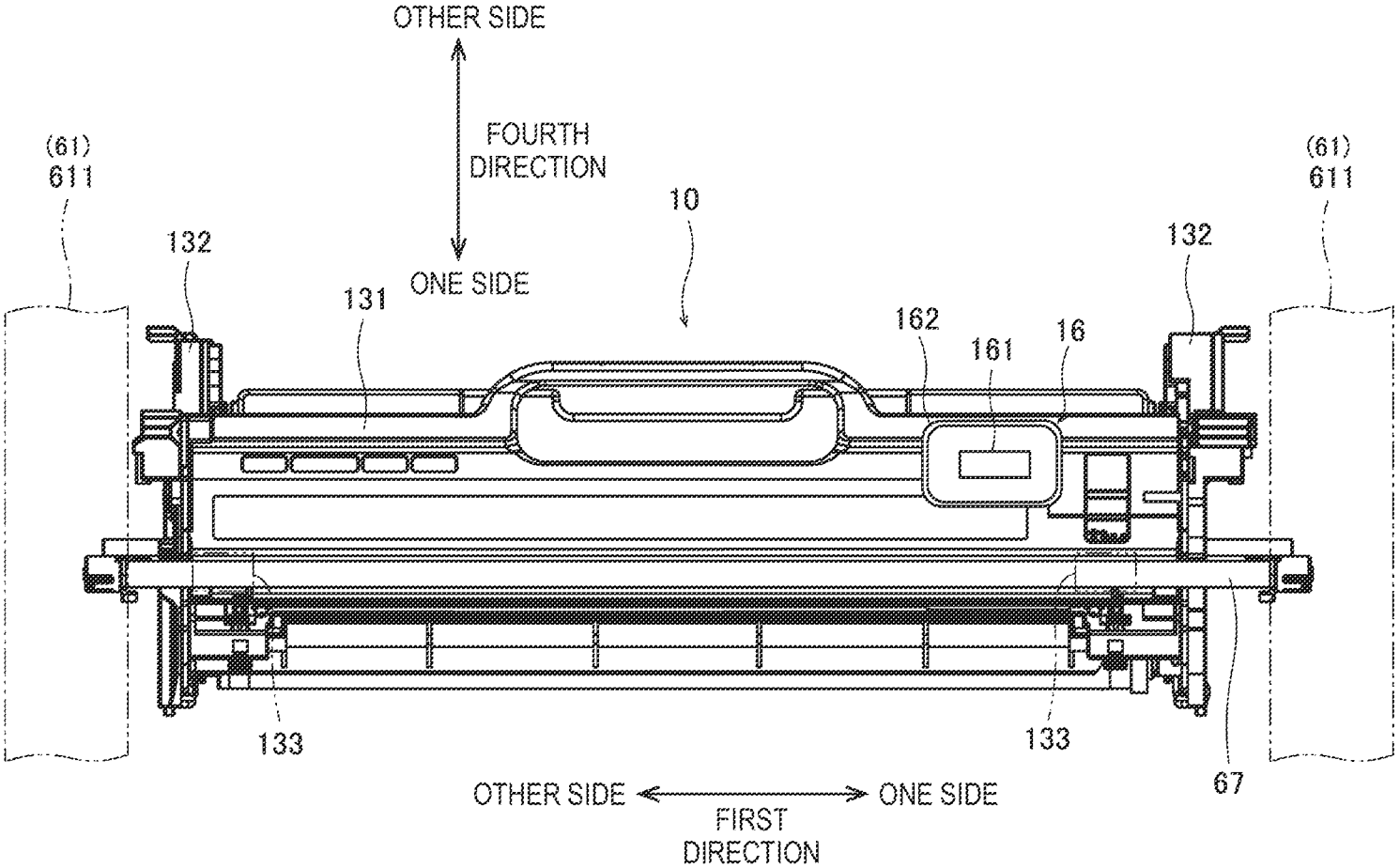
FIG. 19 depicts a drawer and a reference shaft, as seen from one side in a second direction.
Figure 20:
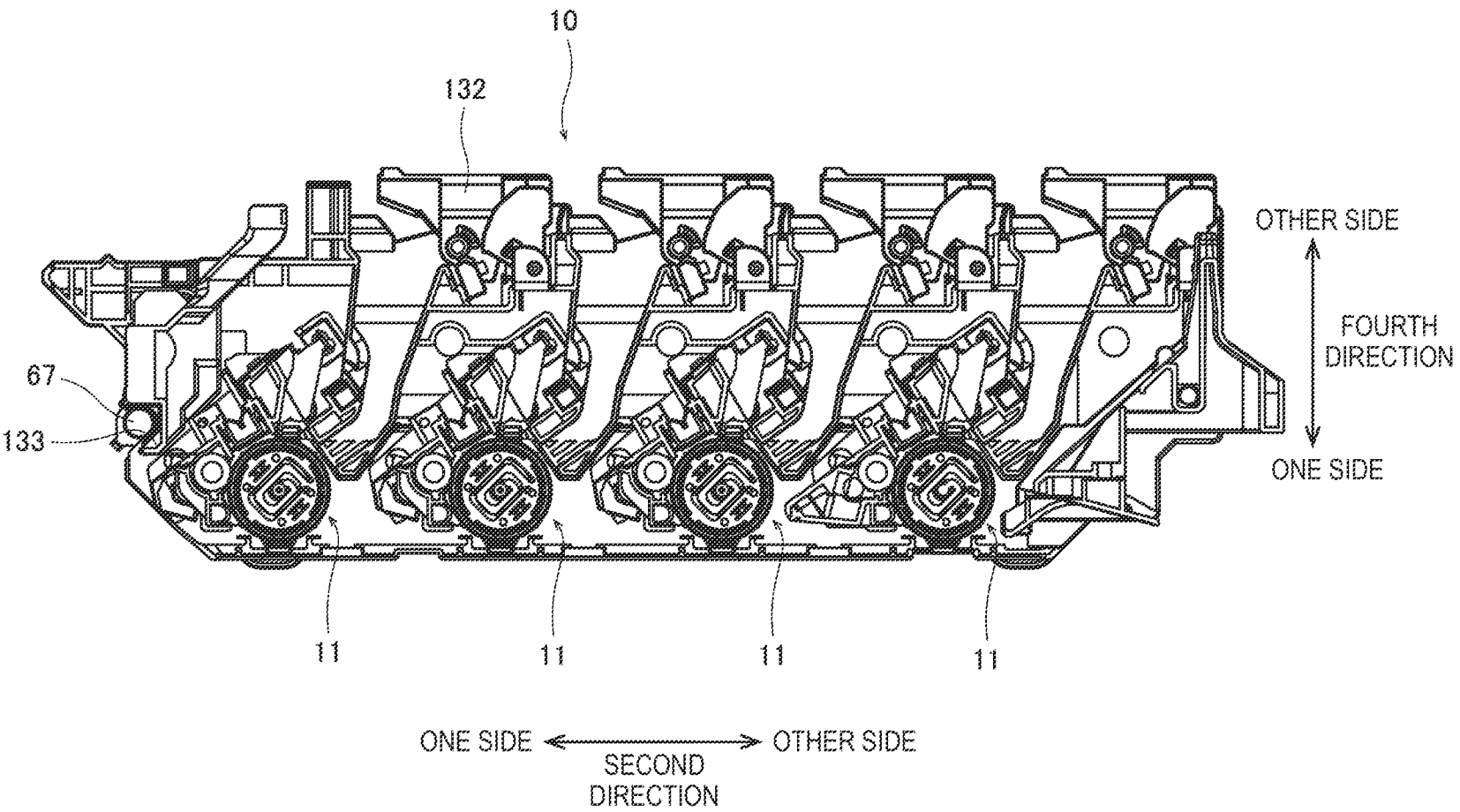
FIG. 20 is a sectional view of the drawer and the reference shaft taken along a plane perpendicular to the first direction.
Figure 21:
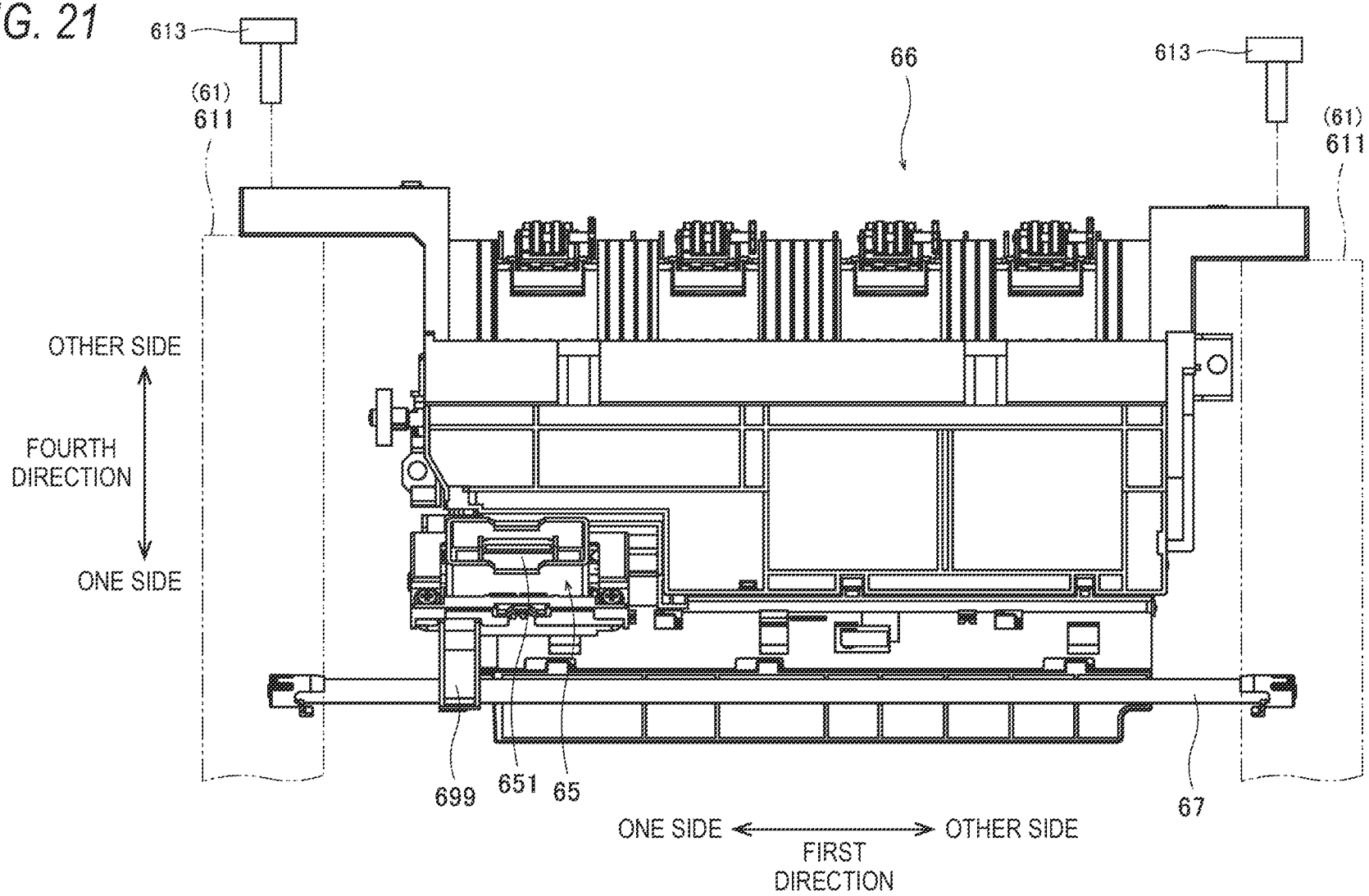
FIG. 21 depicts a sheet discharger and the reference shaft, as seen from the other side in the second direction.
Figure 22:
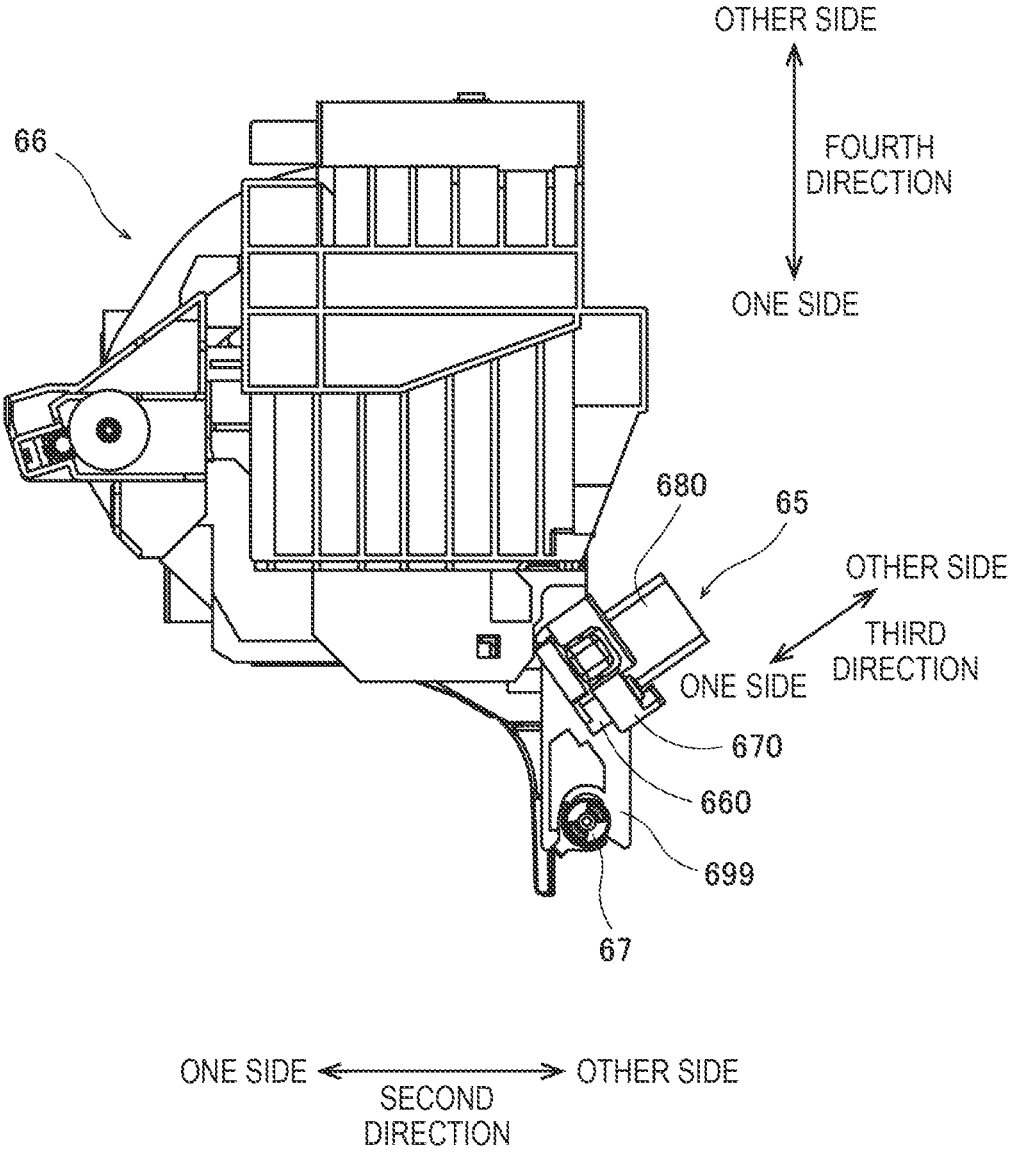
FIG. 22 depicts the sheet discharger and the reference shaft, as seen in the first direction.
Figure 23:
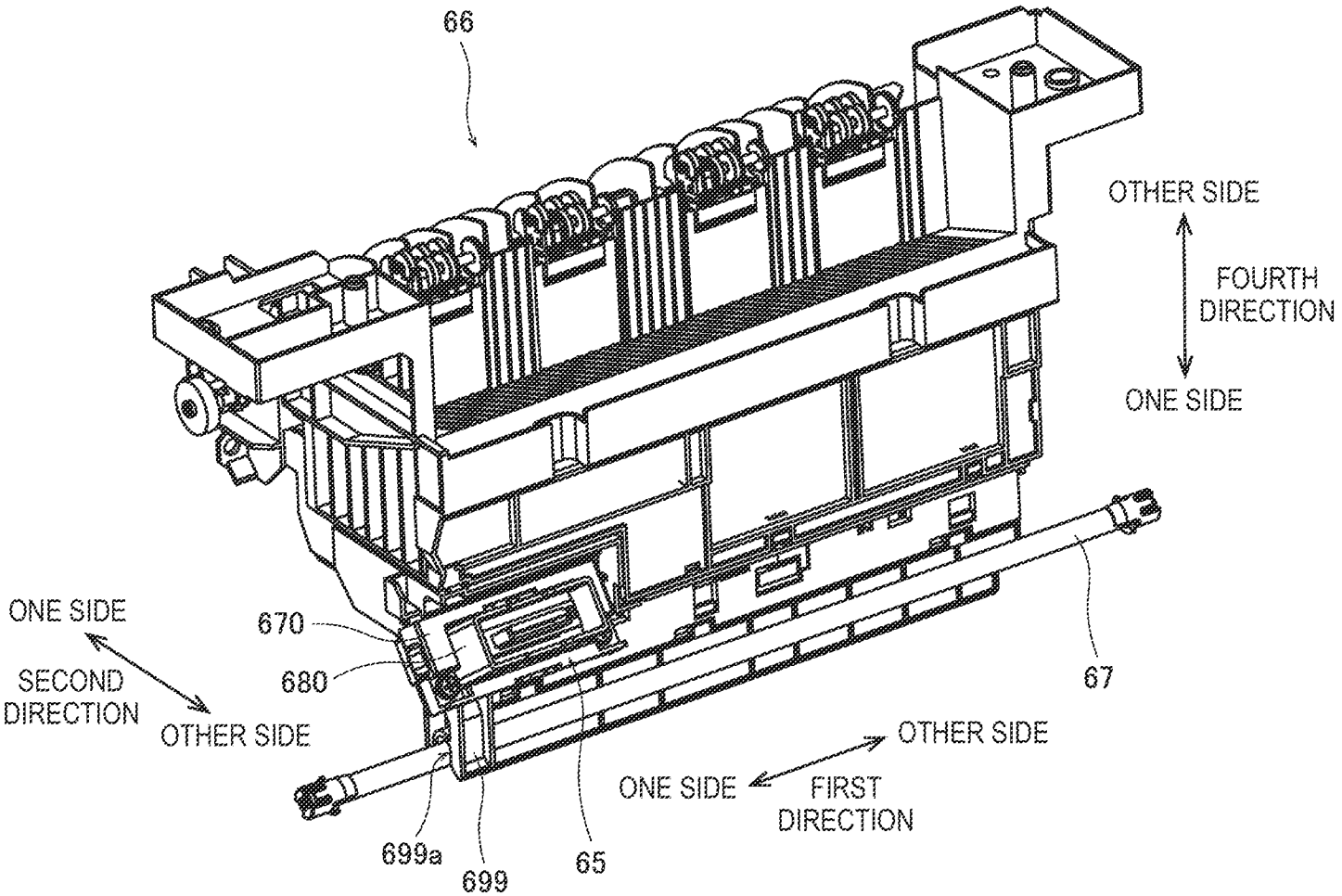
FIG. 23 is a perspective view of the sheet discharger and the reference shaft.

In the below, positioning structures of the drawer 10 and the sheet discharger 66 are described in detail with reference to FIGS. 19 to 23. FIG. 19 depicts the drawer 10 and the reference shaft 67, as seen from one side in the second direction. FIG. 20 is a sectional view of the drawer 10 and the reference shaft 67 taken along a plane perpendicular to the first direction. FIG. 21 depicts the sheet discharger 66 and the reference shaft 67, as seen from the other side in the second direction. FIG. 22 depicts the sheet discharger 66 and the reference shaft 67, as seen in the first direction. FIG. 23 is a perspective view of the sheet discharger 66 and the reference shaft 67.

<1-8-1. Positioning Structure of Drawer>

The image forming apparatus main body 60 of the image forming apparatus 100 has the reference shaft 67 and concave portions 133, as a member relating to positioning of the drawer 10.

The reference shaft 67 is arranged in the housing 61. The reference shaft 67 is a circular column-shaped member extending in the first direction. The reference shaft 67 is located on one side in the third direction with respect to the sheet discharger 66. As shown in FIG. 19, both end portions of the reference shaft 67 in the first direction are fixed to the pair of side frames 611 of the housing 61.

As shown in FIG. 19, the concave portions 133 are located on a downstream surface of the drawer 10 with respect to the insertion direction. That is, as shown in FIG. 20, the concave portion 133 is concave from an outer surface of the drawer 10 on one side in the second direction toward the other side in the second direction. The concave portions 133 are provided in a pair on both sides in the first direction while sandwiching the drawer-side connector 16 therebetween.

When the drawer 10 is inserted in the internal space 610 of the housing 61 and is thus arranged in the installation position, the reference shaft 67 is fitted in the concave portions 133 of the drawer 10. While the drawer 10 is accommodated in the internal space 610 of the housing 61 and is arranged in the installation position, the concave portions 133 press the reference shaft 67. Thereby, the drawer 10 is positioned in the installation position. In the meantime, as shown in FIG. 19, since the concave portions 133 of the drawer 10 press the reference shaft 67 on outermore sides than a central part of the reference shaft 67 in the first direction, the reference shaft 67 is difficult to be bent.

<1-8-2. Positioning Structure of Sheet Discharger>

The attachment part 699 provided to the base 660 of the image forming apparatus 100 also relates to positioning of the drawer 10 and the sheet discharger 66.

The sheet discharger 66 is located between the pair of side frames 611 of the housing 61 in the internal space 610 of the housing 61. The sheet discharger 66 is located at one end portion of the housing 61 in the second direction.

As shown in FIG. 21, one end (an end portion on the other side in the fourth direction) of the sheet discharger 66 in the fourth direction is fastened to the housing 61 by using fastening members 613 such as bolts and the like. Also, the base 660 of the main body-side connector 65 is fixed to the sheet discharger 66. As a result, the attachment part 699 is arranged at the other end portion (an end portion on one side in the fourth direction) of the sheet discharger 66 in the fourth direction. The attachment part 699 is provided along a wall part of the sheet discharger 66 on the other side in the second direction. The attachment part 699 is arranged with being offset toward one side in the first direction with respect to a central position of the sheet discharger 66 in the first direction.

As shown in FIGS. 21 and 22, the attachment part 699 extends in the fourth direction. The attachment part 699 has a notch 699*a* opening toward one side in the fourth direction at an end portion on one side in the fourth direction. The notch 699*a* is formed to penetrate the attachment part 699 in the first direction. The notch 699*a* is attached to the reference shaft 67 from the other side in the fourth direction. Thereby, the reference shaft 67 is inserted in the notch 699*a* of the attachment part 699. As a result, the sheet discharger 66 and the reference shaft 67 are connected therebetween by the attachment part 699. As described above, the attachment part 699 is provided at a part of the main body-side connector 65. In other words, the main body-side connector 65 is supported to the attachment part 699. Thereby, the main body-side connector 65 is supported to a lower end of the sheet discharger 66. As a result, the lower end of the sheet discharger 66 is supported to the reference shaft 67 via the attachment part 699.

In this way, the sheet discharger 66 of the present illustrative embodiment is positioned with accuracy because not only one end (an end portion on the other side) in the fourth direction but also the other end (an end portion on one side) in the fourth direction is supported. Also, the drawer-side connector 16 is connected to the main body-side connector 65 attached to the sheet discharger 66 positioned with accuracy, so that the positioning accuracy of the electrical contact part 161 of the drawer 10 is also improved.

From a different standpoint, the main body-side connector 65 is supported to the reference shaft 67 via the attachment part 699. Also, the drawer-side connector 16 is supported to the reference shaft 67. In this way, since the main body-side connector 65 and the drawer-side connector 16 are supported to the common reference shaft 67, the positioning accuracy of the main body-side electrical contact part 651 and the drawer-side electrical contact part 161 is improved.

<1-9. Positional Relation Between Housing and Drawer>

Figure 24:
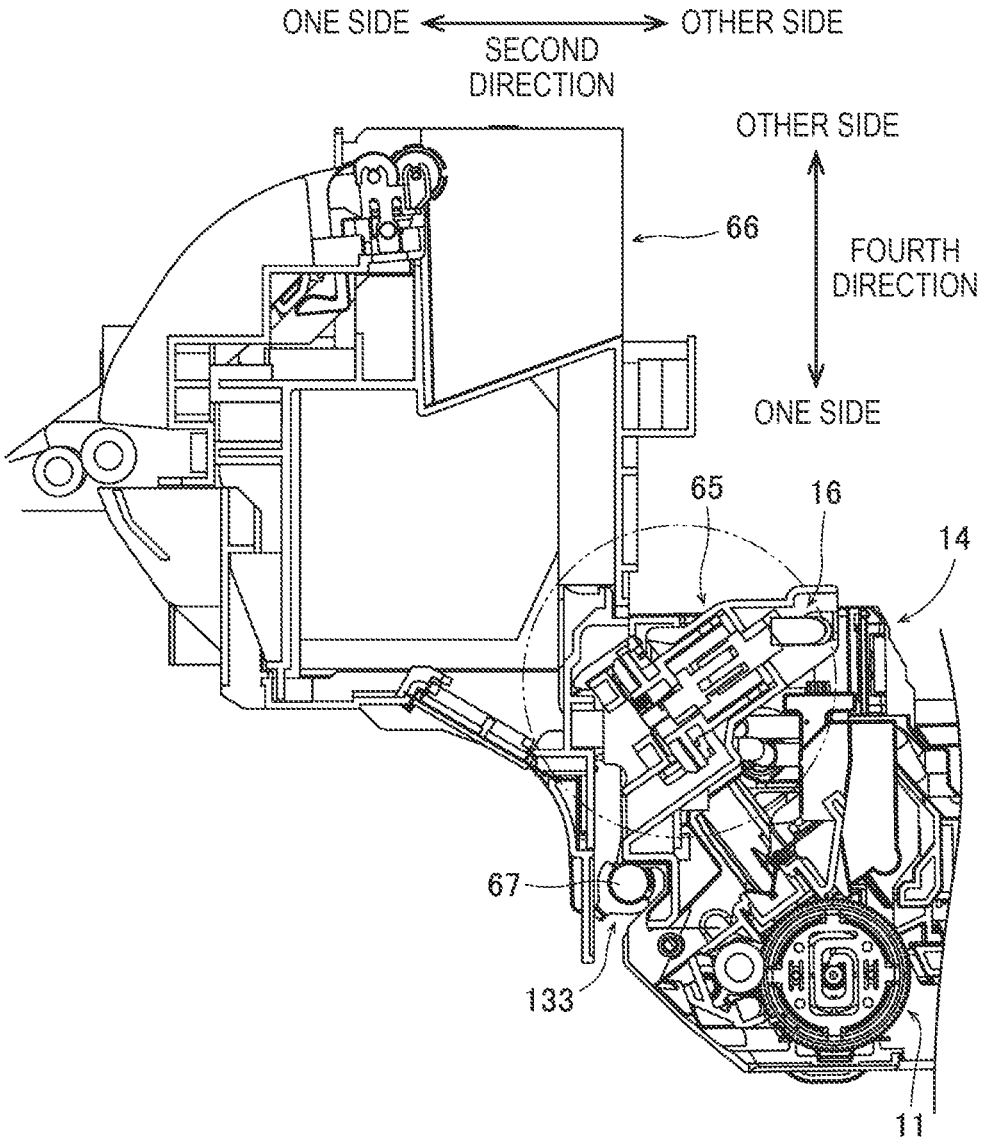
FIG. 24 is a sectional view depicting an aspect in which the image forming apparatus is in a first state.
Figure 25:
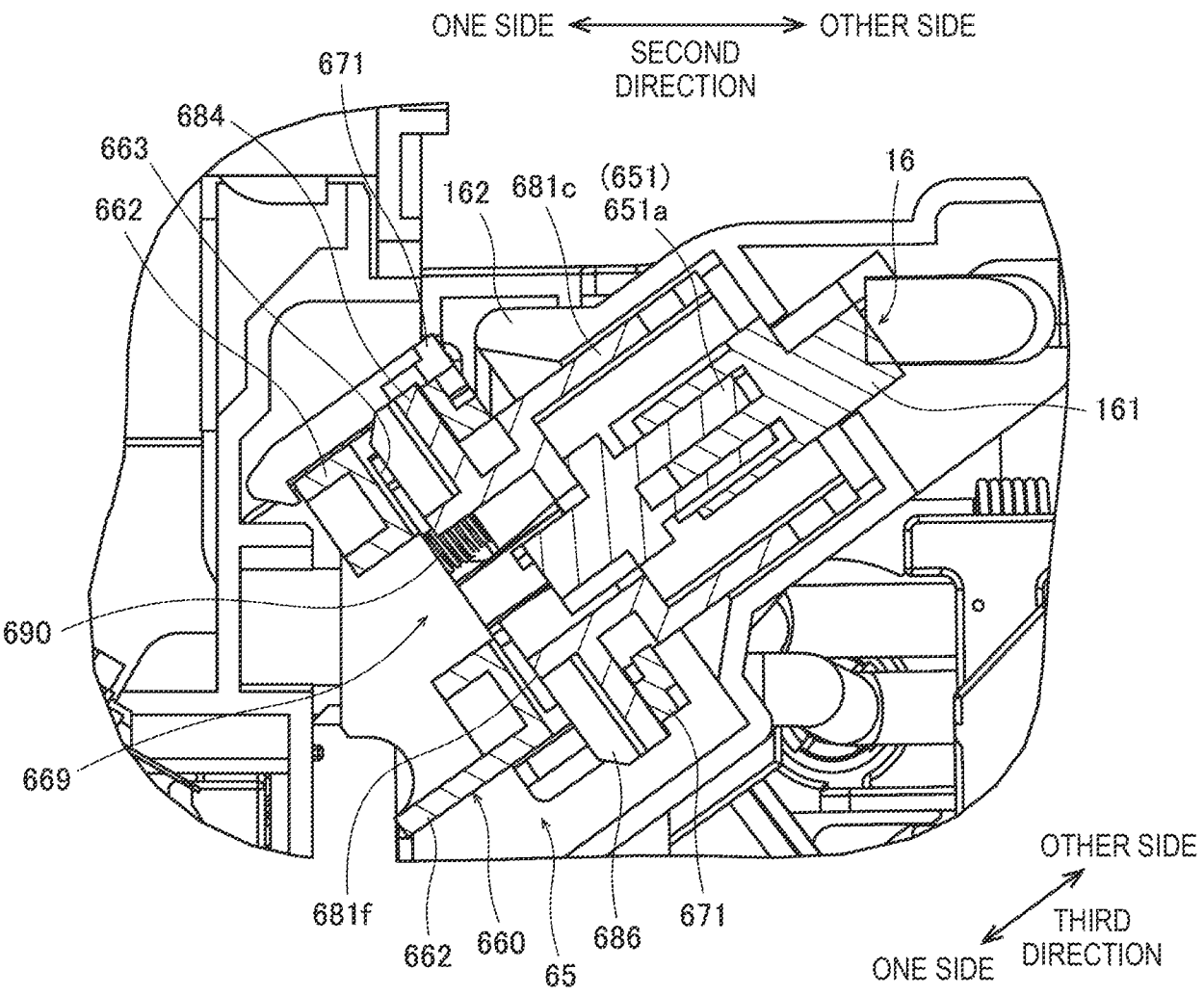
FIG. 25 is a sectional view depicting the main body-side connector and the drawer-side connector in the first state of the image forming apparatus.
Figure 26:
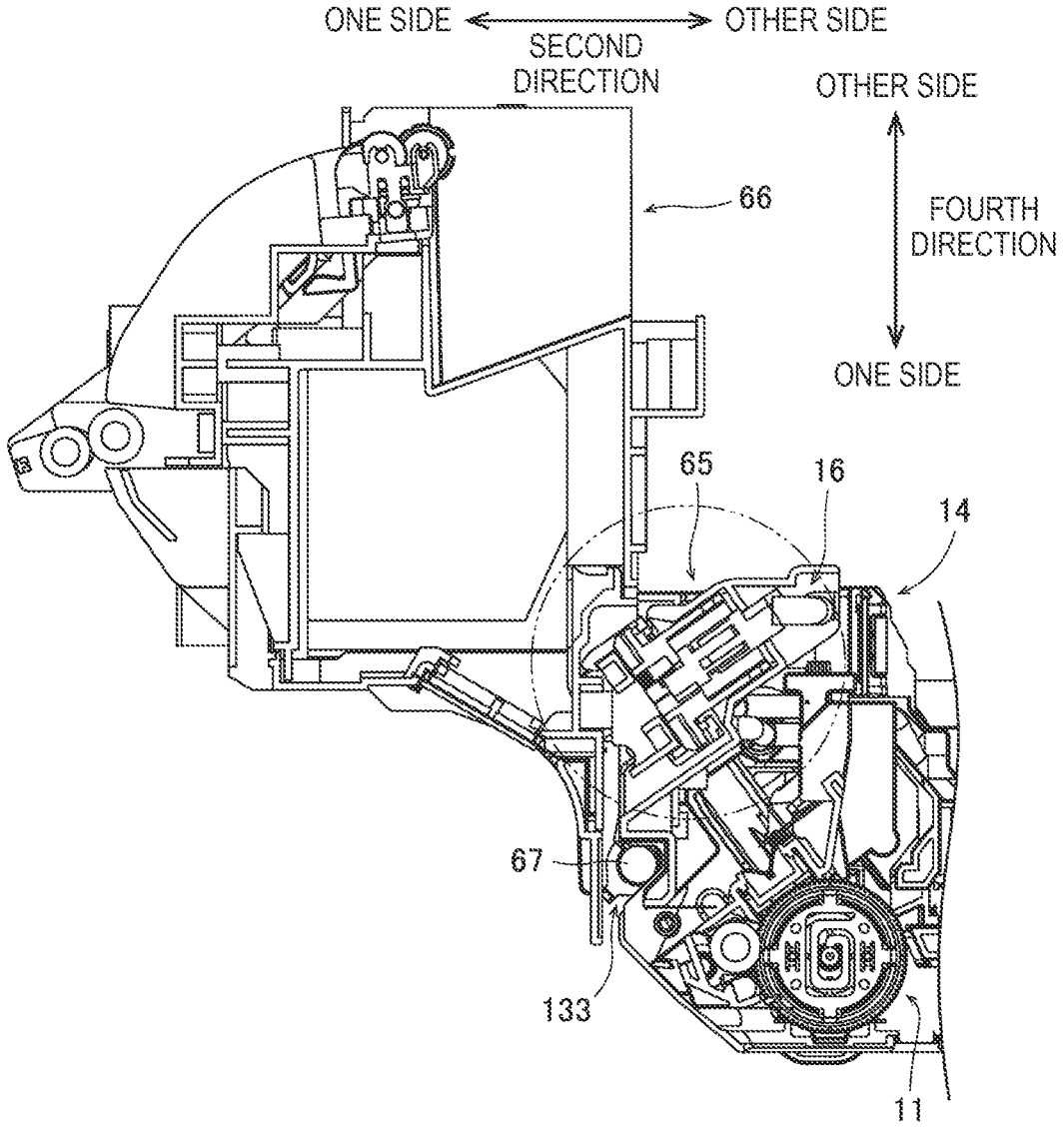
FIG. 26 is a sectional view depicting an aspect in which the image forming apparatus is in a second state.
Figure 27:
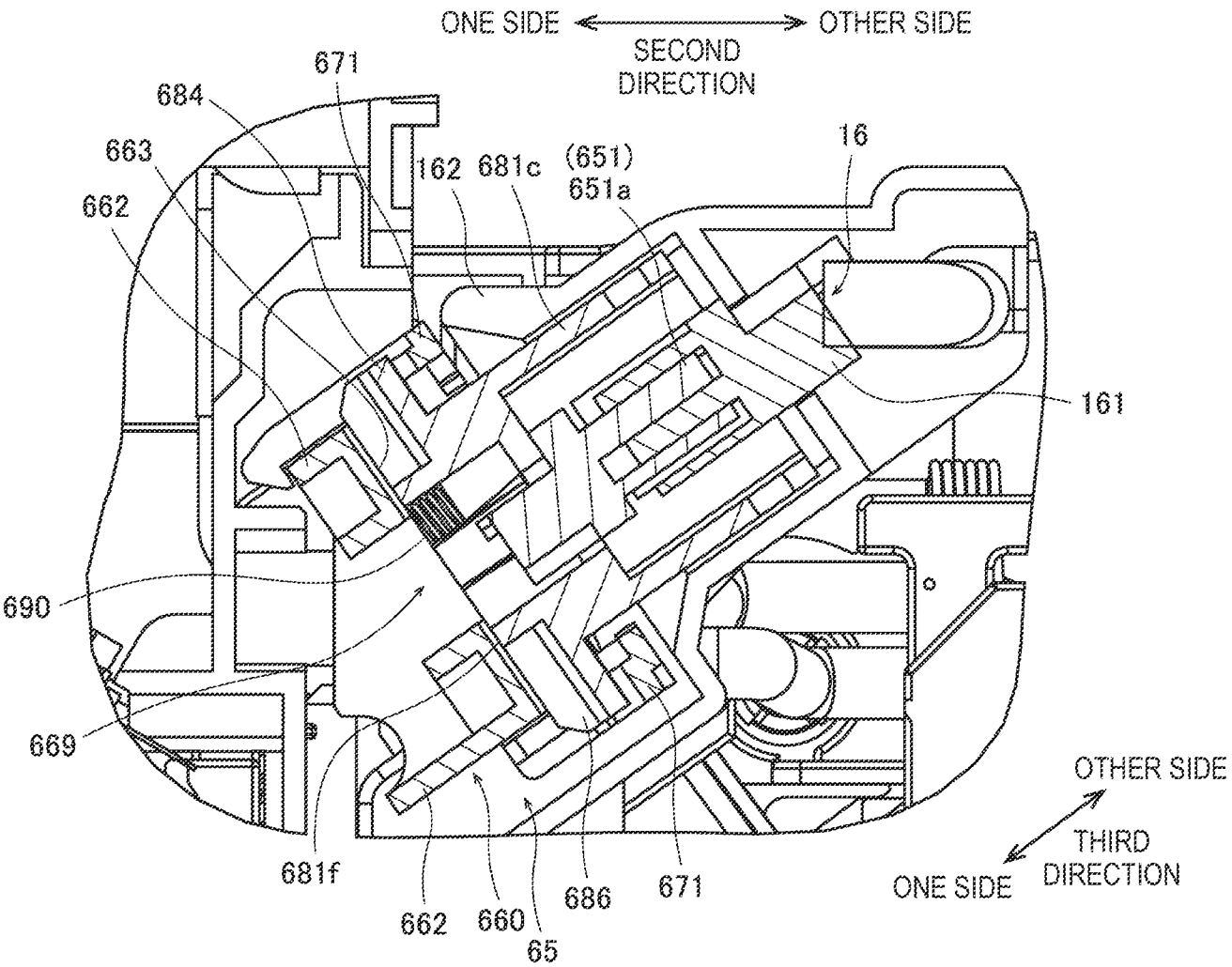
FIG. 27 is a sectional view depicting the main body-side connector and the drawer-side connector in the second state of the image forming apparatus.
Figure 28:
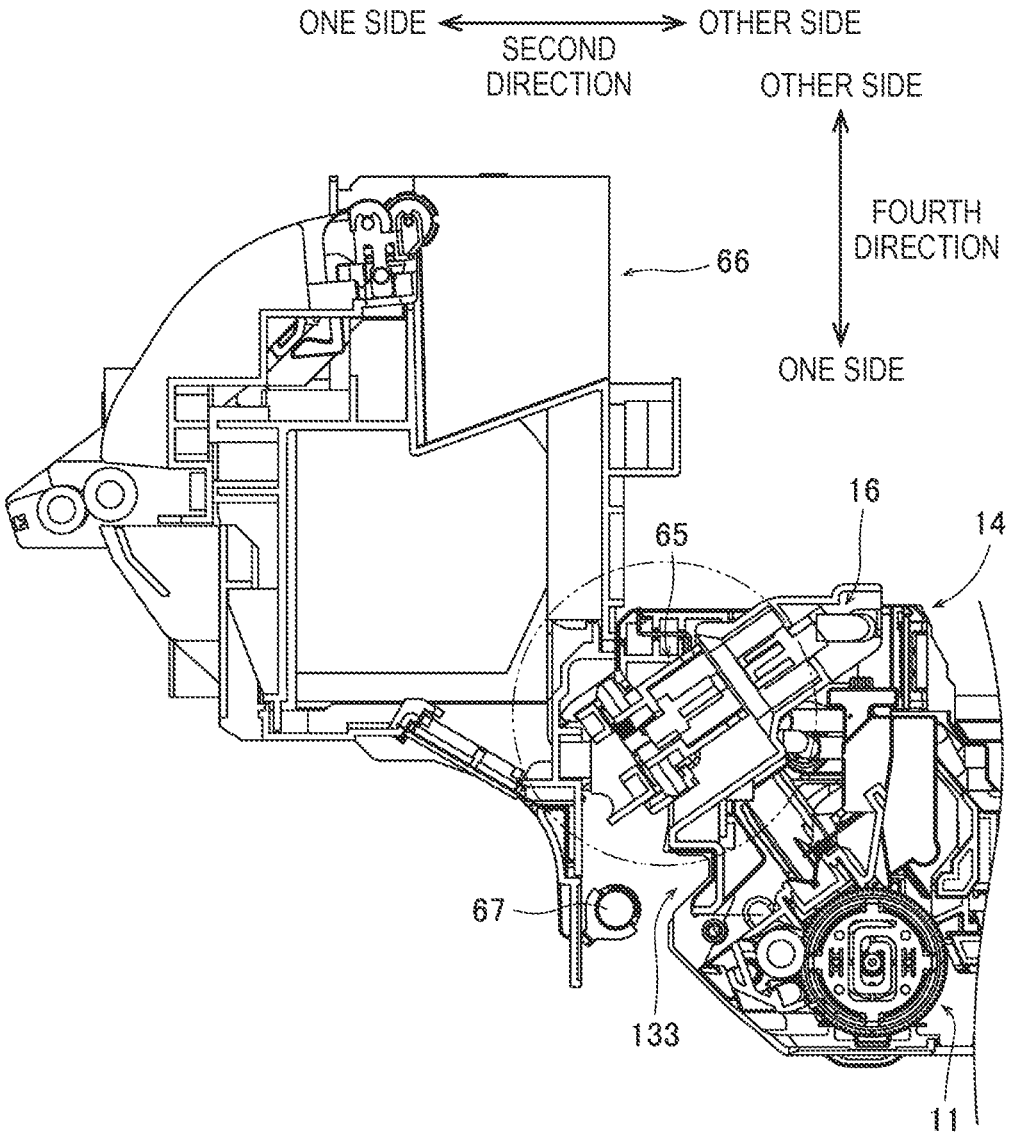
FIG. 28 is a sectional view depicting an aspect in which the image forming apparatus is in a third state.
Figure 29:
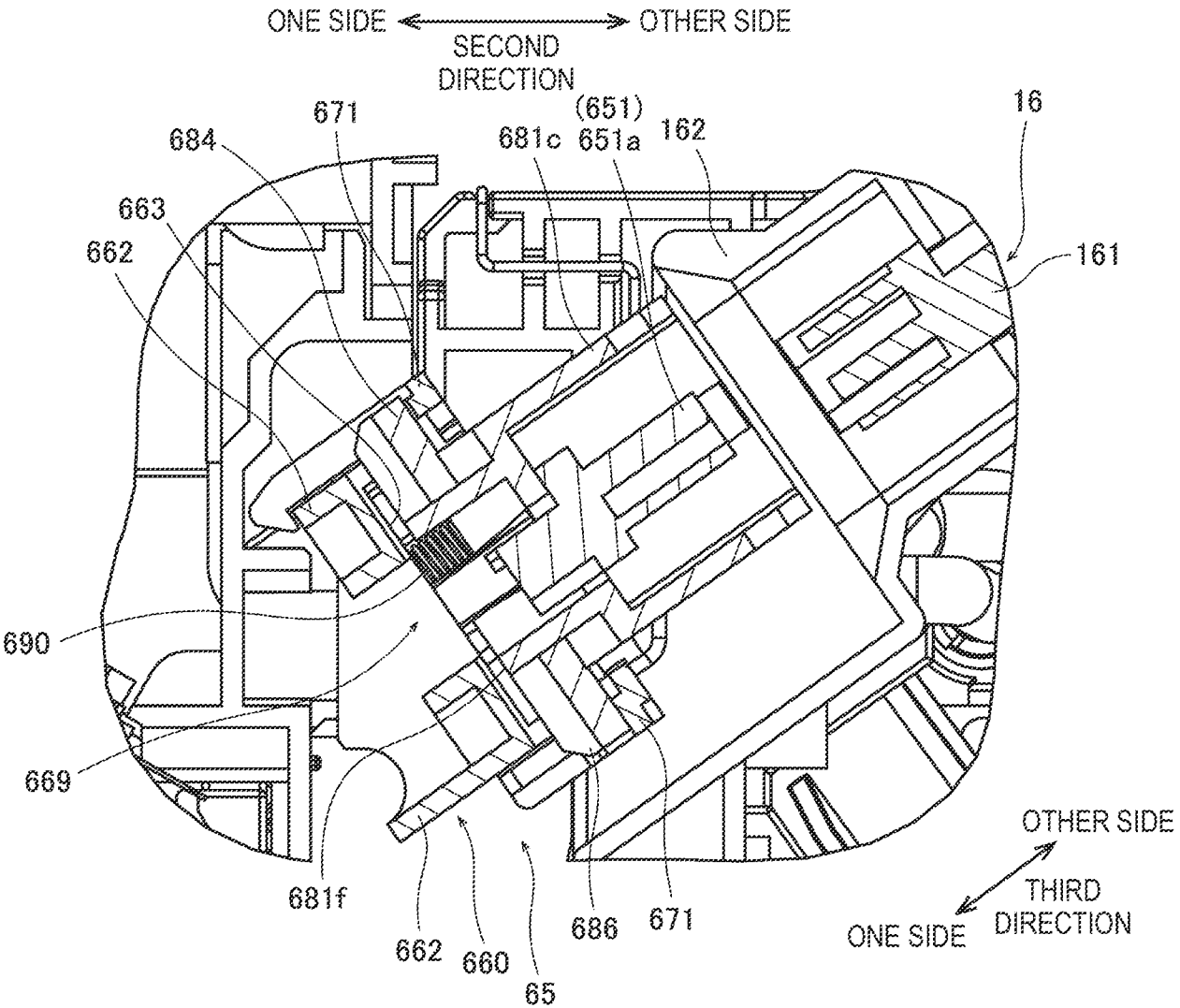
FIG. 29 is a sectional view depicting the main body-side connector and the drawer-side connector in the third state of the image forming apparatus.

In the below, a relative positional relation between the housing 61 and the drawer 10 is described with reference to FIGS. 24 to 29. FIG. 24 is a sectional view depicting an aspect in which the image forming apparatus 100 is in a first state. FIG. 25 is a sectional view depicting the main body-side connector 65 and the drawer-side connector 16 in the first state of the image forming apparatus 100. FIG. 26 is a sectional view depicting an aspect in which the image forming apparatus 100 is in a second state. FIG. 27 is a sectional view depicting the main body-side connector 65 and the drawer-side connector 16 in the second state of the image forming apparatus 100. FIG. 28 is a sectional view depicting an aspect in which the image forming apparatus 100 is in a third state. FIG. 29 is a sectional view depicting the main body-side connector 65 and the drawer-side connector 16 in the third state of the image forming apparatus.

The image forming apparatus 100 can take a first state, a second state, and a third state, as a relative positional relation between the housing 61 and the drawer 10. That is, while a user sets the drawer 10 having the developing cartridges 14 inserted thereto into the housing 61, the image forming apparatus 100 shifts from the third state to the first state, and continuously shifts from the first state to the second state. To the contrary, while the user removes the drawer 10 from the housing 61, the image forming apparatus 100 shifts from the second state to the first state, and continuously shifts from the first state to the third state.

Specifically, as shown in FIG. 2, the pair of side frames 611 of the housing 61 has guide rails 611*a* on the inner surfaces thereof. The guide rail 611*a* extends substantially in the second direction, and extends in the third direction by a slight amount, at a downstream end portion with respect to the second direction. The pair of side plates 132 of the drawer 10 has rollers (not shown) corresponding to the guide rails 611*a* on outer surfaces thereof. The roller is rotatably provided to the side plate 132. When the rollers of the drawer 10 are moved toward one side in the second direction along the guide rails 611*a* of the housing 61, the housing 61 and the drawer 10 can be shifted from the third state to the first state. Also, when the rollers of the drawer 10 are moved toward one side in the third direction along the guide rails 611*a* of the housing 61, on a downstream side of the housing 61 with respect to the insertion direction, the housing 61 and the drawer 10 can be shifted from the first state to the second state.

<1-9-1. First State>

In the first state, the image forming apparatus 100 is in a state in which the drawer 10 is accommodated in the internal space 610 of the housing 61 and the cover 62 is in the open position. When the user rotates the cover 62 to the open position and pushes the drawer 10 in the insertion direction through an opening opened by the cover 62, the image forming apparatus 100 can be set to the first state. That is, the state of the image forming apparatus can be shifted from the third state to the first state by the operating load applied to the drawer 10 by the user.

FIG. 24 is a sectional view depicting an aspect in which the image forming apparatus 100 is in the first state. FIG. 24 depicts an aspect of the drawer 10 and the reference shaft 67, when taken along a section perpendicular to the first direction. In the first state, the reference shaft 67 is not completely fitted in the concave portions 133. In other words, the reference shaft 67 is in contact with opening-side wall surfaces of the concave portions 133.

FIG. 25 is a sectional view depicting the main body-side connector 65 and the drawer-side connector 16 in the first state of the image forming apparatus 100. FIG. 25 depicts an aspect of the main body-side connector 65 and the drawer-side connector 16 taken along a section passing a center of the main body-side connector 65 and perpendicular to the first direction. In this state, the main body-side electrical contact part 651 and the drawer-side electrical contact part 161 are in contact with each other. Specifically, in this state, each electrical contact surface of the drawer-side electrical contact part 161 is in contact with the corresponding electric contact point provided on the main body-side electrical contact part 651.

In the state shown in FIG. 25, the panel 680 is applied with external force toward one side in the third direction as a result of the contact of the drawer-side electrical contact part 161 to the main body-side electrical contact part 651. Correspondingly, the coil springs 690 are compressed, as compared to a case in which the external force is not applied. At this time, a length of the coil spring 690 in the third direction is a first length. However, the compression amount of the coil spring 690 is less than the entire allowance. Therefore, in this state, the first contact surface 663 of the base 660 and the second contact surface 681*f* of the box body 681 of the panel 680 are not in contact with each other. In other words, the main body-side connector 65 is not bottomed. Therefore, it is possible to suppress the excessive load from being applied to the coil spring 690 and the like due to the operating load applied as a result of the user's operation of pushing the drawer 10 into the housing.

<1-9-2. Second State>

In the second state, the image forming apparatus 100 is in a state in which the drawer 10 is accommodated in the internal space 610 of the housing 61 and the cover 62 is in the closed position. That is, the drawer 10 is in the installation position. After the user pushes the drawer 10 in the insertion direction and sets the first state, when the user rotates the cover 62 from the open position to the closed position, the image forming apparatus 100 can be set to the second state. That is, the state of the image forming apparatus can be shifted from the first state to the second state by the load applied to the drawer 10 by the cover 62.

Specifically, a link mechanism (not shown) is provided on an inner side of the cover 62. When the cover 62 is rotated from the open position to the closed position, the link mechanism acts, so that the drawer 10 is pushed in the insertion direction by force greater than the operating load applied by the user. Thereby, the drawer 10 is moved down in the third direction along the downstream shape of the guide rails 611*a* (the shape extending in the third direction). Thereby, the image forming apparatus 100 is in the second state.

FIG. 26 is a sectional view depicting an aspect in which the image forming apparatus 100 is in the second state. FIG. 26 depicts an aspect of the drawer 10 and the reference shaft 67, when taken along a section perpendicular to the first direction. In the second state, the reference shaft 67 is completed fitted in the concave portions 133. That is, the wall surfaces of the concave portions 133 are pressed to the peripheral surface of the reference shaft 67.

FIG. 27 is a sectional view depicting the main body-side connector 65 and the drawer-side connector 16 in the second state of the image forming apparatus 100. FIG. 27 depicts an aspect of the main body-side connector 65 and the drawer-side connector 16, when taken along a section passing a center of the main body-side connector 65 and perpendicular to the first direction. In this state, the main body-side electrical contact part 651 and the drawer-side electrical contact part 161 are in contact with each other more deeply (over a wider contact area) than in the first state. Specifically, each electrical contact surface of the drawer-side electrical contact part 161 is in contact with the corresponding electric contact point provided on the main body-side electrical contact part 651.

In the state shown in FIG. 27, the panel 680 is applied with external force toward one side in the third direction as a result of the action of the link mechanism. Correspondingly, the coil springs 690 are compressed by the entire allowance. At this time, the length of the coil spring 690 in the third direction is a second length shorter than the first length. In this state, the first contact surface 663 of the base 660 and the second contact surface 681*f* of the box body 681 of the panel 680 are contactable with each other. In other words, the main body-side connector 65 may be bottomed only while the cover 62 is in the closed position and the link mechanism acts on the drawer 10. To the contrary, the main body-side connector 65 is not bottomed in other cases. Therefore, it is possible to suppress the excessive load from being applied to the coil springs 690 and the like due to the operating load applied to the drawer 10.

<1-9-3. Third State>

In the third state, the image forming apparatus 100 is in a state in which the drawer 10 is partially accommodated in the internal space 610 of the housing 61 and the cover 62 is in the open position. That is, at this time, the drawer 10 is in the separation position. When the user rotates the cover 62 to the open position and takes out the drawer 10 in an opposite direction to the insertion direction from the opening opened by the cover 62, the image forming apparatus 100 can be set to the third state. In the third state, the drawer 10 is not applied with the operating load from the user.

FIG. 28 is a sectional view depicting an aspect in which the image forming apparatus 100 is in the third state. FIG. 28 depicts an aspect of the drawer 10 and the reference shaft 67, when taken along a section perpendicular to the first direction. In the third state, the reference shaft 67 is not in contact with the concave portions 133, i.e., separates from the concave portions 133.

FIG. 29 is a sectional view depicting the main body-side connector 65 and the drawer-side connector 16 in the third state of the image forming apparatus 100. FIG. 29 depicts an aspect of the main body-side connector 65 and the drawer-side connector 16, when taken along a section passing a center of the main body-side connector 65 and perpendicular to the first direction. In this state, the main body-side electrical contact part 651 and the drawer-side electrical contact part 161 are not in contact with each other, i.e., separates from each other.

In the state of FIG. 29, at least one of the first protrusion 684 and the third protrusion 686 of the panel 680 is in contact with the inner surface of the notch 674*a*, 674*b* of the cover 670 on the other side in the third direction. At this time, the compression amount of the coil spring 690 is less than in the first state. At this time, the length of the coil spring 690 in the third direction is a third length longer than the first length. Therefore, in this state, the first contact surface 663 of the base 660 and the second contact surface 681*f* of the box body 681 of the panel 680 separate relatively largely from each other without contacting each other. Therefore, in the third state, even if the image forming apparatus 100 is applied with vibrations, shock and the like, the main body-side connector 65 is difficult to be bottomed. Therefore, it is possible to prevent excessive load from being applied to the constitutional members of the main body-side connector 65.

As described above, the image forming apparatus 100 disclosed in the present disclosure includes the drawer 10, and the image forming apparatus main body 60. The drawer 10 includes the photosensitive drums 11, the frame 12, the drum memory (drawer memory) 13 and toner memories (drawer memory) 15, and the drawer-side connector 16. The image forming apparatus main body 60 includes the housing 61, the controller 64, the cover 62, and the main body-side connector 65. The main body-side connector 65 includes the main body-side electrical contact part 651, and the main body-side holder 652. The main body-side holder 652 includes the base 669, the cover 670, the panel 680, and the coil springs (elastic member) 690. The main body-side holder 652 is configured to hold the panel 680 so as to be movable relative to the base 660 in a direction corresponding to deformation of the coil springs 690. The main body-side connector 65 is configured to hold the main body-side electrical contact part 651 and the panel 680 so as to be movable relative to the base 660 in the third direction, which is an extension and contraction direction in which the coil spring 690 is to extend and contract. The image forming apparatus 100 can take the first state and the second state. In the first state, (1) the drawer 10 is accommodated in the internal space 610, and the cover 62 is in the open position, (2) the drawer-side electrical contact part 161 is in contact with the main body-side electrical contact part 651, and (3) the length of the coil spring 690 in the third direction is the first length. In the second state, (1) the drawer 10 is accommodated in the internal space 610, and the cover 62 is in the closed position, (2) the drawer-side electrical contact part 161 is in contact with the main body-side electrical contact part 651, and (3) the length of the coil spring 690 in the third direction is the second length shorter than the first length. Thereby, when interconnecting the main body-side connector 65 and the drawer-side connector 16, the drawer-side electrical contact part 161 is contacted to the main body-side electrical contact part 651 more deeply than in the first state only when the drawer 10 is accommodated in the internal space 610 and the cover 62 is rotated from the open position to the closed position. In other words, before the cover 62 is rotated to the closed position, the drawer-side electrical contact part 161 is not deeply contacted to the main body-side electrical contact part 651, as compared to the second state. Therefore, the load, which is to be applied to the drawer-side connector 16 and the main body-side connector 65 as the drawer 10 is accommodated in the internal space 610, can be suppressed from increasing.

Also, in the image forming apparatus 100 disclosed in the present disclosure, the base 660 and the cover 670 of the main body-side holder 652 of the main body-side connector 65 are configured to hold the main body-side electrical contact part 651 so as to be movable in the direction intersecting with the third direction. Thereby, even when there is an error in the positional relation between the drawer-side connector 16 and the main body-side connector 65, the drawer-side connector 16 and the main body-side connector 65 can be interconnected while absorbing the user's operating load to reduce the load to be applied to the drawer-side connector 16 and the main body-side connector 65.

Also, in the image forming apparatus 100 disclosed in the present disclosure, the coil springs 690, which are the elastic member of the main body-side holder 652, press the main body-side electrical contact part 651 and the panel 680 in the third direction. Thereby, while the drawer 10 is accommodated in the internal space 610 and the cover 62 is rotated from the open position to the closed position, the pressing force of the coil springs 690 of the main body-side holder 652 changes. As a result, the main body-side holder 652 functions as a damper, so that it is possible to suppress high load from being applied to the electrical contact parts 651 and 161, the holders 652 and 162 configured to accommodate therein the same, and the like.

Also, in the image forming apparatus 100 disclosed in the present disclosure, the elastic member is the coil spring 690. Thereby, it is possible to easily move the main body-side electrical contact part 651 in the third direction and in the direction perpendicular to the third direction, due to the characteristics of the coil spring 690.

Also, in the image forming apparatus 100 disclosed in the present disclosure, the main body-side holder 652 of the main body-side connector 65 includes the base 660, the cover 670, and the panel 680. The base 660 has the first contact surface 663. The panel 680 has the second contact surface 681*f*. When the image forming apparatus 100 is in the second state, the main body-side holder 652 has no gap between the first contact surface 663 and the second contact surface 681*f*. Thereby, in the second state, when the main body-side connector 65 and the drawer-side connector 16 are interconnected so that the electrical contact parts 651 and 161 thereof are to deeply contact each other, no gap is formed between the first contact surface 663 and the second contact surface 681*f*. When the image forming apparatus 100 is in a state other than the second state, there is a gap between the first contact surface 663 and the second contact surface 681*f*. Therefore, it is possible to suppress high load from being applied to the electrical contact parts 651 and 161 of the connectors 65 and 16, the holders 652 and 162 configured to accommodate therein the same, and the like.

Also, the image forming apparatus 100 disclosed in the present disclosure can take the third state. In the third state, (1) the drawer 10 is partially accommodated in the internal space 610, and the cover 62 is in the open position, (2) the drawer-side electrical contact part 161 is not in contact with the main body-side electrical contact part 651, and (3) the length of the coil spring 690 in the third direction is the third length longer than the first length. Thereby, in the state in which the drawer 10 is only partially accommodated in the internal space 610, the drawer-side electrical contact part 161 and the main body-side electrical contact part 651 are not in contact with each other. Therefore, it is possible to prevent unstable communication from being performed between the drawer memory 13, 15 and the controller 64.

Also, in the image forming apparatus 100 disclosed in the present disclosure, when the cover 62 is rotated from the closed position to the open position in the state in which the drawer 10 is accommodated in the internal space 610, the image forming apparatus 100 shifts from the second state to the first state. Thereby, even when the cover 62 is rotated to the open position from the state in which the drawer 10 is accommodated in the internal space 610 and the cover 62 is located in the closed position to, the drawer-side electrical contact part 161 and the main body-side electrical contact part 651 remain contacted. Therefore, it is possible to solve concerns that communication between the drawer memory 13, 15 and the controller 64 will be interrupted due to the opening/closing operation of the cover 62.

<2. Modification to Illustrative Embodiments>

In the above-described illustrative embodiment, the developing cartridges 14 of respective colors are inserted to the drawer 10 as the common drum cartridge. Alternatively, the drum cartridge and the developing cartridge form a pair, and the pair of cartridges of each color (process cartridge) may be individually inserted to the drawer.

In the above-described illustrative embodiment, the main body-side electrical contact part 651 of the main body-side connector 65 has the female connector terminal. Alternatively, the main body-side electrical contact part may have a male connector terminal. In this case, the drawer-side connector may have a female connector terminal.

In the above-described illustrative embodiment, the plurality of electrical contact surfaces is aligned at the drawer-side electrical contact part 161, and the plurality of corresponding electric contact points is aligned on the main body-side electrical contact part 651. However, the present disclosure is not limited thereto. For example, the plurality of electrical contact surfaces may be aligned on the main body-side electrical contact part 651, and the plurality of corresponding electric contact points may be aligned on the drawer-side electrical contact part 161.

In the above-described illustrative embodiment, the elastic member is the coil spring 690. However, the present disclosure is not limited thereto. For example, as the elastic member, a plate spring, a sponge, a rubber material or the like may also be used.

In the above-described illustrative embodiment, the attachment part 699 is provided to the base 660 of the main body-side connector 65. Alternatively, a connection member may be provided separately from the member configuring the main body-side connector 65.

In the above-described illustrative embodiment, the attachment part 699 has the notch 699*a* in which the reference shaft 67 is to be fitted. Alternatively, the attachment part may have a through-hole in which the reference shaft 67 is to be fitted.

In the above-described illustrative embodiment, the main body-side connector 65 is connected to the sheet discharger 66. However, the present disclosure is not limited thereto. For example, the main body-side connector 65 may be connected to a structure (unit) other than the sheet discharger 66.

In the above-described illustrative embodiment, the image forming apparatus 100 includes, as the drawer memory, the drum memory 13 and the toner memory 15. However, the present disclosure is not limited thereto. For example, the drawer memory may have only the toner memory.

Also, the configuration and detailed shape of the image forming apparatus can be appropriately changed without departing from the scope of the present disclosure. Also, the respective elements disclosed in the illustrative embodiment and the modified illustrative embodiments can be appropriately combined with no inconsistency.

As discussed above, the disclosure may provide at least the following illustrative, non-limiting aspects.

(1) An image forming apparatus comprising: a drawer comprising: a frame configured to hold a plurality of photosensitive drums while spacing the plurality of photosensitive drums at intervals in a second direction, each of the plurality of photosensitive drums being rotatable about an axis extending in a first direction; a drawer memory storing at least one of information about at least one of the plurality of photosensitive drums and information about developing cartridges removably insertable to the frame; and a drawer-side connector located at an outer surface of the frame on one side in the second direction and on a downstream side of the drawer with respect to an insertion direction, the drawer-side connector comprising: a drawer-side electrical contact part electrically connected to the drawer memory; and a drawer-side holder configured to hold therein the drawer-side electrical contact part; and an image forming apparatus main body comprising: a housing having an internal space, the drawer being accommodated in the internal space by moving the drawer relative to the housing in the second direction as being the insertion direction; a controller; a cover rotatable between an open position opening the internal space and a closed position closing the internal space; and a main body-side connector comprising: a main body-side electrical contact part located at an inner surface of the housing on one side in the second direction, the main body-side electrical contact part electrically connected to the controller; and a main body-side holder configured to hold therein the main body-side electrical contact part, the main body-side holder comprising: a base; a panel, the main body-side electrical contact part being fixed to the panel; and an elastic member interposed between the base and the panel, the main body-side connector holding the panel to be movable relative to the base in a direction corresponding to deformation of the elastic member, wherein the main body-side connector is configured to hold the main body-side electrical contact part and the panel to be movable relative to the base in a third direction as being an extension and contraction direction of the elastic member, wherein the image forming apparatus is configured to take a first state and a second state, wherein in the first state, the drawer is accommodated in the internal space, and the cover is in the open position, the drawer-side electrical contact part is in contact with the main body-side electrical contact part, and a length of the elastic member in the third direction is a first length, and wherein in the second state, the drawer is accommodated in the internal space, and the cover is in the closed position, the drawer-side electrical contact part is in contact with the main body-side electrical contact part, and the length of the elastic member in the third direction is a second length, the second length being shorter than the first length.

(2) The image forming apparatus of (1), wherein the main body-side holder is configured to hold main body-side electrical contact part to be movable in a direction intersecting with the third direction.

(3) The image forming apparatus of (1) or (2), wherein the main body-side electrical contact part and the panel are held to be movable relative to the base in the third direction and in a direction perpendicular to the third direction.

(4) The image forming apparatus of any one of (1) to (3), wherein the elastic member of the main body-side holder is configured to press the main body-side electrical contact part and the panel in the third direction.

(5) The image forming apparatus of (4), wherein the elastic member is a coil spring.

(6) The image forming apparatus according to (4) or (5), wherein the main body-side holder comprises: the base comprising: a first contact surface that is a flat surface-shaped part perpendicular to the third direction; and a first spring seat, one end of the elastic member in the third direction being connected to the first spring seat; a cover fixed to the base with being overlapped in the third direction; and the panel comprising: an attachment part, the main body-side electrical contact part being attached to the attachment part; a second contact surface facing the first contact surface; and a second spring seat, the other end of the elastic member in the third direction being connected to the second spring seat, and wherein in a case the image forming apparatus is in the second state, the main body-side holder has no gap between the first contact surface and the second contact surface.

(7) The image forming apparatus according to any one of (1) to (6), wherein the image forming apparatus is configured to take a third state that is different from the first state and the second state, and wherein in the third state, the drawer is partially accommodated in the internal space, and the cover is in the open position, the drawer-side electrical contact part is not in contact with the main body-side electrical contact part, and the length of the elastic member in the third direction is a third length, the third length being longer than the first length.

(8) The image forming apparatus of (7), wherein in a case the drawer is displaced in the third direction, the housing and the drawer are shiftable between the first state and the second state.

(9) The image forming apparatus according to (7) or (8), wherein in a case the cover is rotated from the closed position to the open position in a state in which the drawer is accommodated in the internal space, the image forming apparatus shifts from the second state to the first state.

(10) The image forming apparatus according to any one of (1) to (9), wherein the developing cartridges for accommodating toners therein are removably insertable to the frame, wherein toner identification information identifying the developing cartridges and toner life-span information are stored in the drawer memory, and wherein the drawer-side connector and the main body-side connector are configured to be interconnected to relay communication between the drawer memory and the controller.

(11) The image forming apparatus according to any one of (1) to (10), wherein drum identification information identifying the photosensitive drums and drum life-span information are stored in the drawer memory, and wherein the drawer-side connector and the main body-side connector are configured to be interconnected to relay communication between the drawer memory and the controller.

According to the aspects (1) to (11) of the present disclosure, the image forming apparatus capable of enabling smooth connection between the electrical contact part on the drawer-side and the electrical contact part on the image forming apparatus main body-side and suppressing load to be applied to the drawer-side connector and the main body-side connector is provided.

According to the aspect (1) of the present disclosure, upon interconnection of the main body-side connector and the drawer-side connector, the drawer-side electrical contact part is in deeper contact with the main body-side electrical contact part than in the first state only when the drawer is accommodated in the internal space and the cover is rotated from the open position to the closed position. In other words, the drawer-side electrical contact part is not in deep contact with the main body-side electrical contact part, as compared to the second state, until the cover is rotated to the closed position. Therefore, it is possible to suppress the load, which is applied to the drawer-side connector and the main body-side connector as the drawer is accommodated in the internal space, from increasing.

According to the aspect (2) of the present disclosure, even when an error occurs in a positional relation between the drawer-side connector and the main body-side connector, both the connectors can be interconnected while absorbing the user's operating load to reduce the load to be applied to the drawer-side connector and the main body-side connector, so that According to the aspect (4) of the present disclosure, while accommodating the drawer in the internal space and rotating the cover from the open position to the closed position, the pressing force of the elastic member of the main body-side holder changes. As a result, the main body-side holder functions as a damper, so that it is possible to suppress high load from being applied to the electrical contact part, the holder configured to accommodate the electrical contact part, and the like.

According to the aspect (5) of the present disclosure, it is possible to easily move the main body-side electrical contact part in the third direction and in the direction perpendicular to the third direction, due to characteristics of the coil spring.

According to the aspect (6) of the present disclosure, when the main body-side connector and the drawer-side connector are interconnected so that the electrical contact parts thereof are to be in deep contact with each other, in the second state, no gap is formed between the first contact surface and the second contact surface. When the image forming apparatus is in a state other than the second state, there is a gap between the first contact surface and the second contact surface. Therefore, it is possible to suppress high load from being applied to the electrical contact part of the connector, the holder configured to accommodate the electrical contact part, and the like.

According to the aspect (11) of the present disclosure, in a state in which the drawer is only partially accommodated in the internal space, the drawer-side electrical contact part and the main body-side electrical contact part are not in contact with each other. Therefore, it is possible to prevent unstable communication from being performed between the drawer memory and the controller.

According to the aspect (9) of the present disclosure, even when the cover is rotated to the open position from the state in which the drawer is accommodated in the internal space and the cover is located in the closed position, the drawer-side electrical contact part and the main body-side electrical contact part remain contacted. Therefore, it is possible to solve concerns that communication between the drawer memory and the controller will be interrupted due to the opening/closing operation of the cover.

What is claimed is:

1. An image forming apparatus comprising:
- a drawer comprising:
  - a frame configured to receive a toner cartridge; and
  - a drawer-side connector comprising:
    - a drawer-side electrical contact part configured to electrically connected to a memory; and
    - a drawer-side holder configured to hold therein the drawer-side electrical contact part; and
- an image forming apparatus main body comprising:
  - a housing having an internal space, the drawer being accommodated in the internal space by moving the drawer relative to the housing;
  - a controller; and
  - a main body-side connector comprising:
    - a main body-side electrical contact part located at an inner surface of the housing, the main body-side electrical contact part electrically connected to the controller; and
    - a main body-side holder configured to hold therein the main body-side electrical contact part, the main body-side holder comprising:
      - a base;
      - a panel, the main body-side electrical contact part being fixed to the panel; and
      - an elastic member interposed between the base and the panel,
      - the main body-side connector holding the panel to be movable relative to the base in a first direction corresponding to deformation of the elastic member,
- wherein the main body-side connector is configured to hold the main body-side electrical contact part and the panel to be movable relative to the base in a second direction as being an extension and contraction direction of the elastic member,
- wherein the image forming apparatus is configured to take a first state and a second state,
- wherein in the first state,
  - the drawer is accommodated in the internal space,
  - the drawer-side electrical contact part is in contact with the main body-side electrical contact part, and
  - a length of the elastic member in the second direction is a first length, and
- wherein in the second state,
  - the drawer is accommodated in the internal space,
  - the drawer-side electrical contact part is in contact with the main body-side electrical contact part, and
  - the length of the elastic member in the second direction is a second length, the second length being shorter than the first length.

2. The image forming apparatus according to claim 1, wherein the elastic member of the main body-side holder is configured to press the main body-side electrical contact part and the panel in the second direction.

3. The image forming apparatus according to claim 2, wherein the elastic member is a coil spring.

4. The image forming apparatus according to claim 2, wherein the main body-side holder comprises:
- the base comprising:
  - a first contact surface; and
  - a first spring seat, one end of the elastic member in the second direction being connected to the first spring seat;
- a cover fixed to the base with being overlapped in the second direction; and
- the panel comprising:
  - an attachment part, the main body-side electrical contact part being attached to the attachment part;
  - a second contact surface facing the first contact surface; and
  - a second spring seat, the other end of the elastic member in the second direction being connected to the second spring seat, and wherein in a case the image forming apparatus is in the second state, the main body-side holder has no gap between the first contact surface and the second contact surface.

5. The image forming apparatus according to claim 1, wherein the image forming apparatus is configured to take a third state that is different from the first state and the second state, and wherein in the third state, the drawer is partially accommodated in the internal space, the drawer-side electrical contact part is not in contact with the main body-side electrical contact part, and the length of the elastic member in the second direction is a third length, the third length being longer than the first length.

6. The image forming apparatus according to claim 5, wherein in a case the drawer is displaced in the second direction, the housing and the drawer are shiftable between the first state and the second state.

7. The image forming apparatus according to claim 1, wherein the toner cartridge for accommodating toner therein is removably insertable to the frame, wherein the toner cartridge includes the memory, and wherein the drawer-side connector and the main body-side connector are configured to be interconnected to relay communication between the memory and the controller.

* * * * *